US009293001B2

(12) United States Patent
Anderson et al.

(10) Patent No.: US 9,293,001 B2
(45) Date of Patent: Mar. 22, 2016

(54) TRANSIENT OR PERSISTENT GAME PLAY IN WAGERING GAMES

(75) Inventors: Peter R. Anderson, Glenview, IL (US); Vincent P. Chan, Chicago, IL (US); Mark B. Gagner, West Chicago, IL (US); Daniel Murphy, Chicago, IL (US); Larry Pacey, Chicago, IL (US); Craig J. Sylla, Round Lake, IL (US); Matthew J. Ward, Northbrook, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 2301 days.

(21) Appl. No.: 12/158,855

(22) PCT Filed: Dec. 6, 2006

(86) PCT No.: PCT/US2006/046483
§ 371 (c)(1),
(2), (4) Date: Jun. 23, 2008

(87) PCT Pub. No.: WO2007/078533

PCT Pub. Date: Jul. 12, 2007

(65) Prior Publication Data

US 2008/0300049 A1 Dec. 4, 2008

Related U.S. Application Data

(60) Provisional application No. 60/743,073, filed on Feb. 23, 2005, provisional application No. 60/745,691, filed on Apr. 26, 2006.

(51) Int. Cl.
*G07F 17/32* (2006.01)

(52) U.S. Cl.
CPC ..... *G07F 17/3239* (2013.01); *G07F 17/32* (2013.01); *G07F 17/3281* (2013.01)

(58) Field of Classification Search
CPC .. G07F 17/32; G07F 17/3239; G07F 17/3281
USPC ..... 463/16–20, 25
See application file for complete search history.

(56) References Cited

U.S. PATENT DOCUMENTS 662,281 A 11/1900 Mather
6,117,013 A 9/2000 Eiba (Continued)

FOREIGN PATENT DOCUMENTS

DE 10304725 A1 9/2004
EP 1422673 A1 5/2004

(Continued)

OTHER PUBLICATIONS

Evry, Harry J., Beginning Game Graphics, Published Jan. 1, 2005, pp. 26, 29 and 44.*

(Continued)

*Primary Examiner* — David L Lewis
*Assistant Examiner* — Shauna-Kay Hall
(74) *Attorney, Agent, or Firm* — Nixon Peabody, LLP

(57) ABSTRACT

According to one example embodiment disclosed herein, a wagering game is operated on a first platform, wherein the first platform is capable of supporting all or fewer than all of a plurality of game assets associated with the wagering game, and further wherein the wagering game is capable of receiving a wager. The wagering game is operated on a second platform that is capable of supporting all or fewer than all of the plurality of game assets. A player may accumulate one or more player assets while the wagering game is played on the first platform. At least one of the accumulated player assets is transferred to the play of the wagering game on the second platform, wherein at least one capability of the first platform is different from a corresponding capability on the second platform.

29 Claims, 13 Drawing Sheets

(56) References Cited

U.S. PATENT DOCUMENTS

| | | | | |
|---|---|---|---|---|
| 6,811,486 | B1 | 11/2004 | Luciano, Jr. | |
| 7,278,068 | B1 | 10/2007 | Crowder, Jr. | |
| 2003/0027628 | A1 | 2/2003 | Luciano | |
| 2003/0064805 | A1* | 4/2003 | Wells | 463/39 |
| 2003/0104868 | A1* | 6/2003 | Okita et al. | 463/42 |
| 2003/0114220 | A1* | 6/2003 | McClintic | 463/25 |
| 2003/0176218 | A1* | 9/2003 | LeMay et al. | 463/25 |
| 2003/0224852 | A1 | 12/2003 | Walker et al. | |
| 2003/0225834 | A1 | 12/2003 | Lee et al. | |
| 2003/0232647 | A1* | 12/2003 | Moser | G07F 17/32 463/29 |
| 2003/0232651 | A1* | 12/2003 | Huard et al. | 463/42 |
| 2004/0075769 | A1* | 4/2004 | Shy et al. | 348/565 |
| 2004/0198494 | A1 | 10/2004 | Nguyen et al. | |
| 2004/0257434 | A1 | 12/2004 | Davis et al. | |
| 2005/0024532 | A1 | 2/2005 | Choi | |
| 2005/0096128 | A1 | 5/2005 | Walker et al. | |
| 2005/0170893 | A1 | 8/2005 | Muir et al. | |
| 2005/0233811 | A1 | 10/2005 | Gatto | |
| 2005/0239546 | A1 | 10/2005 | Hedrick et al. | |
| 2005/0256985 | A1 | 11/2005 | Shea | |
| 2005/0270303 | A1 | 12/2005 | Li | |
| 2006/0019745 | A1* | 1/2006 | Benbrahim | G06Q 20/341 463/29 |
| 2006/0035707 | A1 | 2/2006 | Nguyen et al. | |
| 2006/0040741 | A1 | 2/2006 | Griswold et al. | |
| 2006/0205513 | A1 | 9/2006 | Breckner et al. | |
| 2006/0205514 | A1 | 9/2006 | Cockerille et al. | |
| 2006/0281554 | A1 | 12/2006 | Gatto et al. | |
| 2007/0207854 | A1 | 9/2007 | Wolf et al. | |
| 2007/0298856 | A1* | 12/2007 | Gilmore et al. | 463/16 |
| 2008/0096671 | A1 | 4/2008 | Gagner et al. | |
| 2010/0234099 | A1 | 9/2010 | Rasmussen et al. | |
| 2010/0240442 | A1 | 9/2010 | Anderson | |

FOREIGN PATENT DOCUMENTS

| | | | |
|---|---|---|---|
| JP | 2005033721 | | 2/2005 |
| WO | WO-9850889 | A1 | 11/1998 |
| WO | WO-0195608 | A2 | 12/2001 |
| WO | 03/027970 | A2 | 4/2003 |
| WO | WO-03089078 | A1 | 10/2003 |
| WO | WO-2007098017 | A2 | 8/2007 |
| WO | WO-2007098017 | A3 | 8/2007 |

OTHER PUBLICATIONS

Scott Mueller, Upgrading and Repairing PCs, Aug. 27, 2004, Que, Sixteenth Edition, pp. 881-883, 917-918, 932-933.*

Michael Morrison, Beginning Game Programming, Jul. 19, 2004, Sams, pp. 203-205, 264-266.*

Harry J. Evry, Beginning Game Graphics, Jan. 1, 2005, Course Technology PTR, pp. 26-29, 38-42, 44.*

Alexander Brandon, Audio for Games: Planning, Process, and Production, Oct. 7, 2004, New Riders, pp. 42-44.*

"International Search Report for Application No. PCT/US2006/46483, date mailed Jun. 29, 2007", 4 pgs.

"Written Opinion of the International Searching Authority for Application No. PCT/US2006/46483, date mailed Jun. 29, 2007", 5 pgs.

"U.S. Appl. No. 12/279,834, Non Final Office Action mailed Jun. 2, 2011" 14 pgs.

"European Application Serial No. 06839061.6, Extended European Search Report mailed Feb. 2, 2011", 11 pgs.

"International Application Serial No. PCT/US2007/04062, International Search Report and Written Opinion mailed Aug. 20, 2008", 9 pgs.

* cited by examiner

TRANSIENT OR PERSISTENT GAME PLAY IN WAGERING GAMES

RELATED APPLICATIONS

This patent application is a U.S. National Stage Filing under 35 U.S.C. 371 from International Patent Application Serial No. PCT/US2006/046483, filed Dec. 6, 2006, and published on Jul. 12, 2007 as WO 2007/078533 A2 and republished as WO 2007/078533 A3, which claims the benefit of priority of U.S. Provisional Patent Application Ser. No. 60/743,073 filed on Dec. 23, 2005 and entitled "Transient Or Persistent Game Play In Wagering Games" and of U.S. Provisional Patent Application Ser. No. 60/745,691 filed on Apr. 26, 2006 and entitled "Transient Or Persistent Game Play In Wagering Games", the contents of which are hereby incorporated by reference in their entirety.

COPYRIGHT

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2005, 2006, WMS Gaming, Inc.

FIELD

Embodiments of the inventive subject matter relate generally to wagering games, and more particularly to methods, machines and systems to provide transient game play in wagering games.

BACKGROUND

Wagering game makers continually provide new and entertaining games. One way of increasing entertainment value associated with casino-style wagering games (e.g., video slots, video poker, video blackjack, and the like) includes offering features that extend and enhance the gaming experience, such as described herein.

DETAILED DESCRIPTION

In the following detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Example Operating Environment

Figure 1:
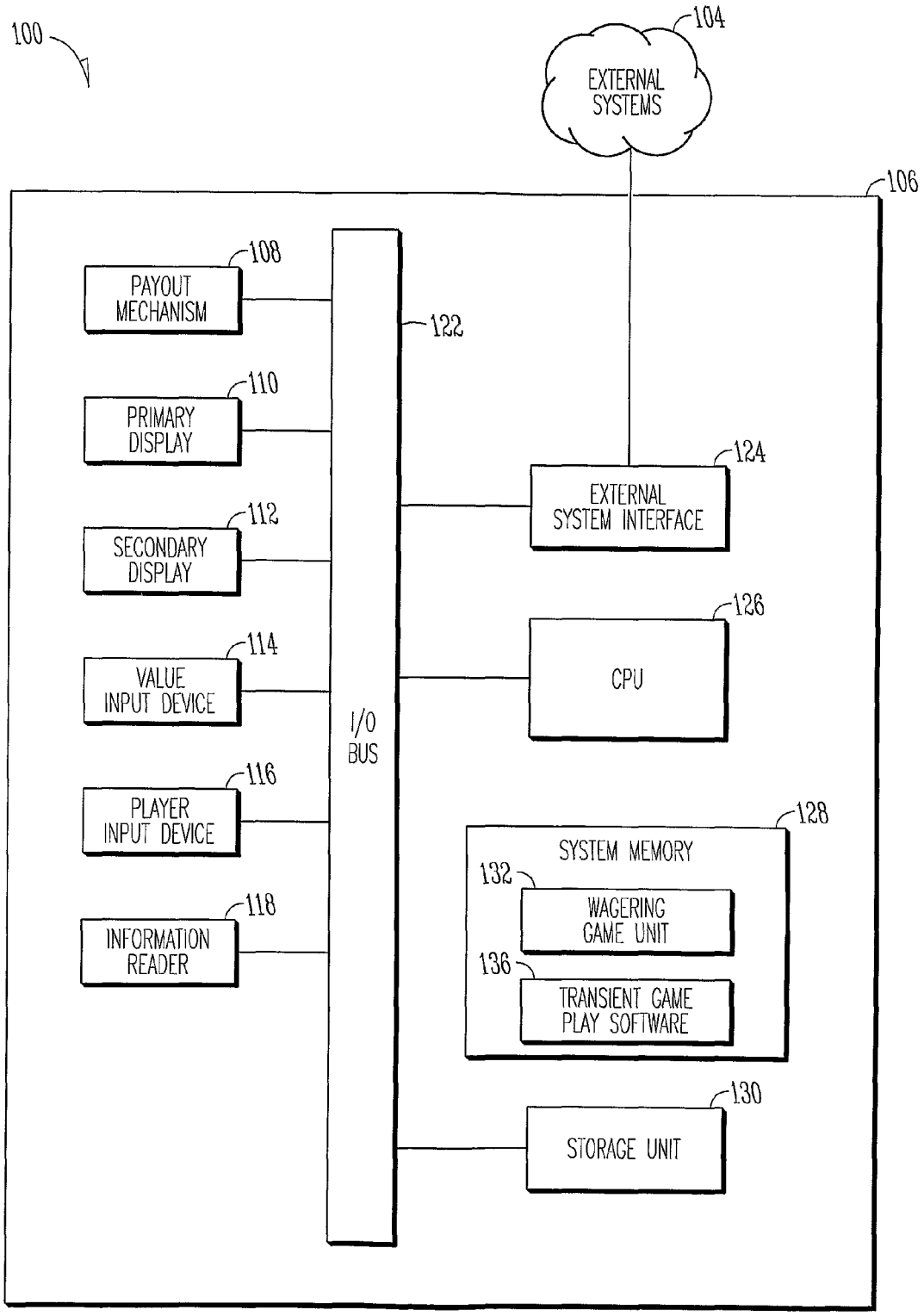
FIG. 1 is a block diagram of a control system suitable for operating a wagering game machine, according to example embodiments to the inventive subject matter.

FIG. 1 is a block diagram of a control system 106 suitable for operating a wagering game machine, according to example embodiments of the invention. As shown in FIG. 1, the control system 106 includes a central processing unit (CPU) 126 connected to a memory unit 128, which includes a wagering game unit 132 and transient game play-related software unit 136. In one embodiment, the wagering game unit 132 can receive wagers and conduct wagering games, such as video poker, video black jack, video slots, video lottery, etc. In one embodiment, the transient game play-related software unit 136 performs various transient game play-related tasks, as described herein.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, and storage unit 130. The I/O bus 122 is also connected to an external system interface 124, which is connected to external systems 104 (e.g., wagering game networks).

In one embodiment, the control system 106 can include additional peripheral devices and/or more than one of each component shown in FIG. 1. For example, in various embodiments, the control system 106 can include one or more external system interfaces 124 and one or more CPUs 126. In one embodiment, any of the components can be integrated or subdivided. Additionally, in one embodiment, the components of the control system 106 can be interconnected according to any suitable interconnection architecture (e.g., directly connected, hypercube, etc.).

In one embodiment, any of the components of the control system 106 (e.g., the transient game play-related software unit 136) can include hardware, firmware, and/or software for performing the operations described herein. Furthermore, any of the components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
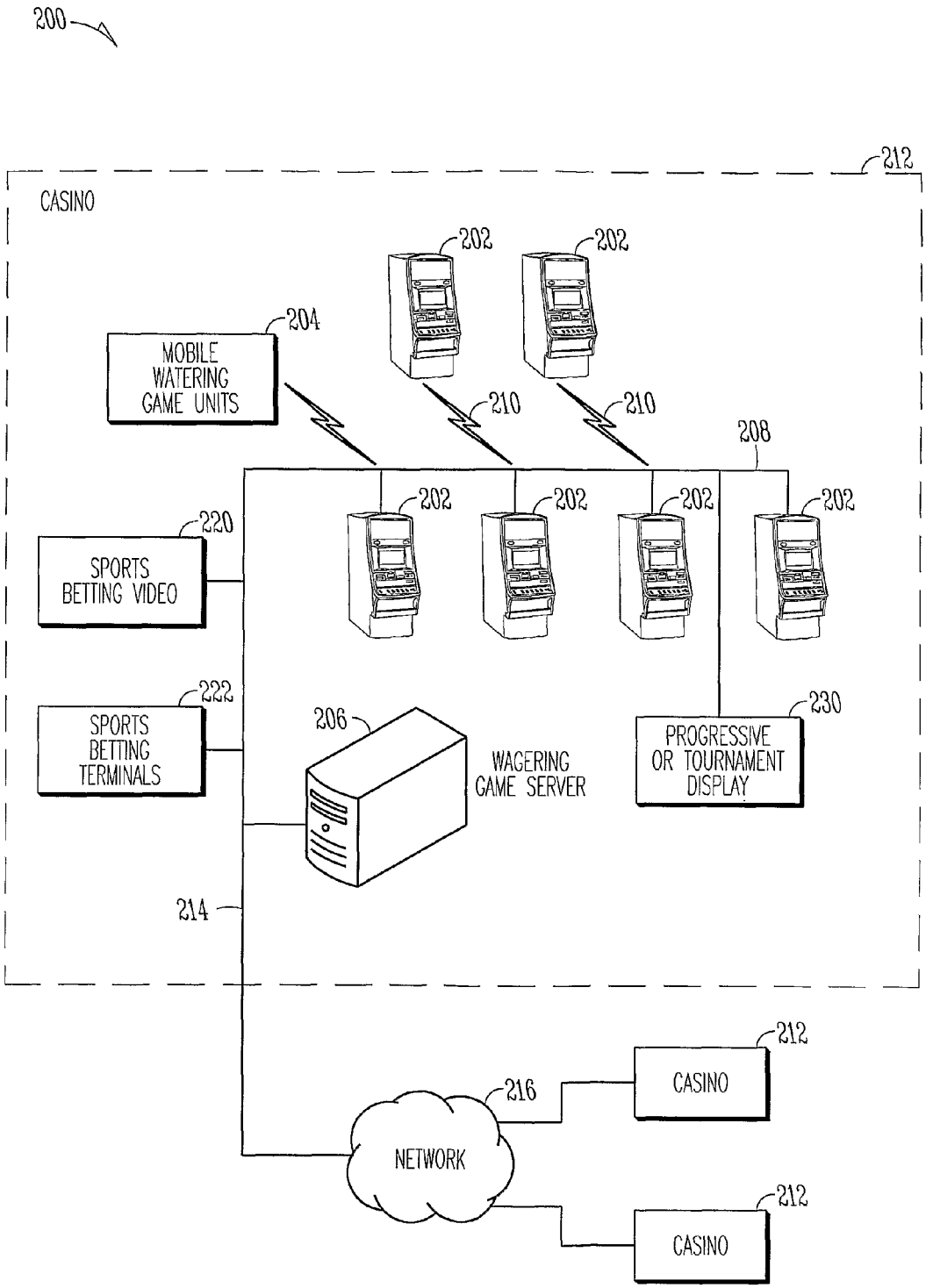
FIG. 2 is a schematic diagram of a wagering game network, according to example embodiments to the inventive subject matter.

FIG. 2 illustrates how a plurality of wagering game machines can form a wagering game network 200. As shown in FIG. 2, the wagering game network 200 includes a plurality of casinos 212 connected to a communications network 216. Each of the plurality of casinos 212 includes a local area network 214, which connects wagering game machines 202 and mobile wagering game units 204 to a wagering game server 206, and connects local area network 214 to the communications network 216. The wagering game machines 202, mobile wagering game unit 204, and wagering game server 206 can include hardware and machine-readable media including instructions for doing various tasks, as described herein. In one embodiment, the wagering game server 206 can perform the various tasks in concert with serving wagering games over the local area network 214.

The wagering game machines described herein can take any suitable form, such as floor standing models, handheld mobile units, bar-top models, workstation-type console models, etc. In addition, the gaming units 202 or 204 may also be computers owned by the patrons or provided to the patron for use in the casino, such as a laptop, tablet or hand-held computer, such as a personal digital assistant (PDA). Further, the mobile wagering game unit 204 may constitute a mobile telephone capable of executing a gaming application or serving as a client in a web-type application using HTML, XML or other technologies with similar or greater capabilities. In one embodiment, the wagering game network 200 can include other network devices, such as accounting servers, wide area progressive (WAP) servers, and/or other devices suitable for use in connection with embodiments of the invention. Further, the casino 212 may also include sports betting facilities for example with video displays 220 and sports betting terminals 222 that may be self-serve or operated by casino personnel. In addition, the casino may include progressive or tournament game displays 230, which may be used to display the pot for a progressive game, for example one conducted in association with a plurality of gaming units 202 or 204, or the pot for a tournament conducted using various gaming units 202 or 204.

According to one example embodiment, a casino 212 may be a permanent physical structure or a temporary structure, such as a tent or temporary building, for example manufactured housing that may be assembled quickly and taken apart once it is no longer needed. For example, such temporary structures may be used to get a casino operation up and running quickly before a permanent structure has been completed, or as temporary quarters while repairs, renovations or additions are made to a permanent casino structure.

The components of each casino 212 can communicate over wired 208 and/or wireless connections 210. Furthermore, they can employ any suitable connection technology, such as Bluetooth, 802.11, Ethernet, public switched telephone networks, SONET, etc. According to one example embodiment, the network 214 may be a mesh network topology, a star topology, a bus topology, a ring topology or a tree topology. Further, the network may be hard-wired or wireless. The wireless network may be a mesh network, or it may be formed of one or more access points coupled to a fixed backbone. According to another example embodiment, a variety of different network cabling/connection schemes and protocols may be employed for communications on the network, for example but not limited to Ethernet (based on Carrier Sense Multiple Access with Collision Detection), LocalTalk (based on Carrier Sense Multiple Access with Collision Avoidance), Token Ring, Fiber Distributed Data Interface (FDDI) or asynchronous transfer mode (ATM). Other protocols for use in communication on the networks 214 and 216, and the Internet, include Internet Protocol (IP), Transmission Control Protocol (TCP), User Datagram Protocol (UDP), HyperText Transfer Protocol (HTTP), File Transfer Protocol (FTP), Internet Protocol version 6 (IPv6), Point-to-Point Protocol (PPP) or Point-to-Point Protocol over Ethernet (PPPOE) and other protocols.

According to one example embodiment, the wireless communication is provided using the IEEE 802.11 standard, known as the Wi-Fi standard, which denotes a set of wireless LAN/WLAN standards developed by working group 11 of the IEEE LAN/MAN Standards Committee. The term is also used to refer to the original 802.11, which is now sometimes called "802.11 legacy." According to another embodiment, the 802.11g Wi-Max standard protocol may be used, or a proprietary wireless communication protocol may be used. In one example embodiment, a plurality of wireless access points are positioned around the casino so as to provide full coverage of the casino floor or adjacent spaces such as the casino grounds or associated hotel rooms and common areas. Further, the network is configured and adapted to accommodate roaming, allowing a mobile wagering game unit 204 to roam around the casino and switch access points seamlessly with no perceptible drop in connection to the user of the device. According to still another example embodiment, there may be provided an electronic door barrier, for example but not necessarily controlled from a central network resource, that disables a mobile wagering game unit 204 when it goes out the door or other perimeter set up for the casino.

According to one example embodiment, the method and apparatus disclosed herein provide for allowing a player to play the same wagering game on more than one platform and have the game states or assets follow them from one platform to the other platform, or shared between platforms. According to another example embodiment, the method and apparatus disclosed herein provide for allowing a player to play more than one session of the same wagering game on a single platform and have the game states or assets be shared between sessions. According to still another example embodiment, the assets or states may be transferred to or shared with other games that are different than the game in which the states or assets are accumulated. In another example embodiment, states or assets may be transferred between tournaments on multiple different platforms or between games in any type of community gaming.

According to another example embodiment, the system and method provides for authentication or identification of the player on each platform to allow the state or assets to be transferred between platforms or sessions. Instant authentication between games running on different platforms may be accomplished with biometric identification, such as a biometric handheld device, or authentication or at least identification of a user can be done using a player tracking card or a user name/password combination. According to still another example embodiment, when switching sessions or platforms of a game, the players have an opportunity to identify what prior session they wish to pick up play of, or to share their assets or states with. This may be accomplished, for example, by showing the user a list of prior play sessions that they can choose to resume.

According to still another example embodiment, once a user is identified at a gaming machine, the machine may reconfigure itself and in one example embodiment personalize itself to the player and continue a game that was terminated at another gaming machine or possibly still in play on another device. According to one example embodiment, the platforms may include a slot machine, a mobile telephone platform, a PDA platform, a personal computer platform, or other platforms. Game states or assets may include, without limitation, credits earned or awarded on a machine, cards dealt in a hand not yet completed, a play status achieved, such as a level achieved in a game with multiple levels of achievement, or tokens or other items awarded to the player that can be transferred to another platform or session and used. In another embodiment, levels or boards or stages achieved in episodic games can be transferred from one platform or session to another. According to still another embodiment, there may be game assets that are unique to a particular game that can be accumulated in a master set of assets. There may also be assets that are common to different games that can be used in different games. In addition, assets may include a buddy list, a previous best or other game play statistics. Further, if a player loses at a device he or she may not lose all game assets.

According to another example embodiment, there is provided method and apparatus to run multiple sessions of same game and share game assets between sessions in parallel or simultaneously, or in a serial fashion. When shared in a serial fashion, the game play is kept in a persistent state when transferred from one platform or session to another. According to still another example embodiment, the system and method provide for maintaining an account for the player, and saving states and assets to the player's account. For example, if the player does not cash out of a machine, the system may automatically save the states or assets. For another example, if a certain amount of time has elapsed with no game play, the system and method may automatically credit the states or assets to the player's account and allow them to restart the machine with those assets or states a later time.

The system and method may also allow the player to make a claim to a game or platform, to allow them to return to the same game at a later time and put more money in or use the credits already accumulated on the game. In another example embodiment, there are provided certain assets that a player may collect on a first game, but have to use or cash out on another device, in order to encourage the player to try other games. In another example embodiment, some assets can only be advanced on one type of device or game, but not the other, but transferred between them. For example, the same game may be available for play on two or more platforms, such as a full sized casino slot machine and a mobile telephone, wherein in the case of one platform not all the game features available on the other platform are possible, either due to a lack of peripherals such as a set top unit, or because of lack of video resolution or speed.

Thus, certain features that can earn credits or assets or produce a certain state in one instance of a game on a first platform may not be available when the game is transferred to another instance of the game on a more limited platform. For instance, the resolution of a mobile telephone display may be much more limited than the display of a full sized personal computer or free stranding slot or video poker machine. In such cases, according to one example embodiment, the method and system may provided for representing the same elements of a game on the lesser capable video device with similar but not identical representations, for instance an elaborate pictorial item on one game implementation on a high resolution or large display may be represented by a letter or an icon on a low resolution or small display. There are various differences in platforms that may be accommodated, for example such platforms may include handhelds such as phones, PDAs, custom devices, video game handhelds, casino uprights, casino table games, tablet computers, or personal computers in casino hotel rooms. These platforms may all have different capabilities relating to different user interfaces, touch screen capable or not, mechanical reels or speed of reels, mechanical top box components and others. These features may be simulated or recreated on less capable platforms for example by slowing the speed of play to accommodate slower processing power, using letters and not spinning reels, bluebird mechanical can be translated to video on a handheld, simulation of mechanical or other top box features on a hand held, or the manner in which spinning can be started.

According to another embodiment, SMS short messaging may be used to send someone a text message to tell a player when a new episode is up to play on a game with episodic play. Such may be provided with auto-updates to bluebird and to a mobile phone when it happens. In another embodiment, the phone or bluebird enables the mobile phone to do something it can do otherwise, for example the player can play bluebird and get an advantage in the mobile phone game. According to another example embodiment of the disclosed subject matter, there are various modes of sharing assets possible. For example, a player may open up different sessions, for example three sessions all contribute to one master set of assets. Credits could be pooled across all sessions on different or the same platform. A player may be able, in another example embodiment, to use one account or two accounts to share assets between, for example the player may have two player tracking cards both tied to the same account. Further, player credits may also be scaled across platforms or sessions. For example, a virtual economy concept may be used wherein something that is worth one amount or value in one game is potentially a different value in a different game. For instance, if one game earns free spins, the other may earn a free selection, and one free spin may be worth two free selections, or the same number of selections. According to still another embodiment, market based gaming concepts may be used to encourage folks to move between different types of devices or games like a big event. According to yet another example embodiment, if a player is wagering on multiple machines, the casino may increase the odds for the player and allow assets or states to be shared. For example, auto-playing multiple accounts may provide a higher percentage chance of winning, or double eligibility may be used to get higher multipliers for odds. In addition, according to another example embodiment, depending on the rate at which the player plays, i.e., coin in, the ability to transfer assets or states provides he or she is less or more eligible for bonuses, wherein the games may be different and earning ability may change, so as to accelerate gaming on some games, with the aim of influencing players to go to a different device where they may continue gambling longer or in greater amounts.

According to another example embodiment, there is provided method and apparatus to avoid a race condition between multiple sessions played by a single player simultaneously, to prevent, for example, the player drawing on credits on a first session from a pool wherein another session has spent all credits in the pool before the first session becomes aware. According to one embodiment, all simultaneous sessions may be supported by the same server or synchronized servers, such that credits have to taken from the server and it is not possible for the server to get out of synchronization. According to another example embodiment, a synchronization mechanism is provided to prevent more than one game drawing on pooled credits simultaneously.

According to still another example embodiment, there is provided method and apparatus for scaling game assets or features between platforms, such as between mechanical and video, between video resolutions, between sound capabilities, between speed differences, between peripheral differences and between other differences. Game play scaling may include scaling between a capabilities available on one platform but not available on another, or a capability less available on one platform vs. another. The scaling of games between platforms, may, in one example embodiment, scale assets from machine to machine that might not automatically scale but instead different content is provided for each platform. In addition, there may not necessarily be the exact same math or calculations between games but such may be tailored for each device. According to one example embodiment, a game may be custom scaled for each device on which it is available. In still another example embodiment, tools to scale may include a smart content tool that is a translation matrix that provides a key in all the different languages and artwork for the various levels of detail, and script language to do automatic scaling According to still further embodiments, scaling game assets may take the form of abstracting the game from the display, animations from actual content, abstract identifiers can make calls and represent different things on different devices, generic calls, devices that can indicate the capabilities of the device so that scaling can be automated, bluebird and hand held, providing three D models to ease scaling, using the same processing but different resolution of display, using different processing and a different display. Other types of scaling may include high resolution graphics that scale in and out of product, animation vs. static elements, full on transitions vs. not in scaled back version, stereo or broadband audio vs. mono, timing between animations vs. not.

In another example embodiment, 3D graphics are scaled to 2D graphics for a mobile phone or PDA application. In another alternate embodiment, there may be something that is video in one system which is scaled to audio in another system, like representing coin-in as beeps vs. display. Or, in another embodiment, scaling may be accomplished by reducing various aspects of detail such as color, resolution, shadows, particle effects, or changing such things as explosive effects to the use words such as "boom" instead. In addition, certain graphics may be pre-processed to speed display time from one machine to another, such as pre-creating polygonal objects vs. real time calculation in an engine.

According to another embodiment, a compression scheme is used to scale images to be smaller, such that they looked like the same thing as the larger scale but tinier, and when decompressed made it look bigger. According to one example embodiment, accordingly, image may be automatically scaled using auto-scaling software. Further, according to one embodiment, a DSP circuit may be used to perform scaling in real time. In another embodiment, game assets may be scaled in real time or selected from alternative assets. According to another example embodiment, a game is scaled in order to accommodate differences in speed between different platforms. For example, in Internet gaming all systems may use a web browser with similar capabilities, but the speed of machine may affect how the game works. In such cases, the example method and apparatus may provide for changing the level of detail in real time in hardware or software. According to still another example embodiment, a user may be allowed to set the level of detail or other features to assist in scaling the game to the user's particular computing platform. For example, the user may dial up or down play features, for example specifying a silent background, or small or big font, or what type of input device is available—i.e., mouse vs. keypad on mobile phone.

According to still another example embodiment, scaling may be used to show multiple sessions at same time on the same platform. For example each session may be scaled down for display, for example to show play of multiple sets of reels. In such a case, this may be a window of a server-based game wherein the player keeps adding games in windows until the resolution remaining is too low to support play. For example, the player may run multiple simultaneous poker games, for example as many as sixteen or more. Such games may share assets such as draw cards or wild cards or other assets. According to still another example embodiment, multiple games may be controlled by one device, for example one set of credit meters—could have master controls to spin all, or controls may be slaved together so the player can spin from one and make them play together in synchronized fashion, or a mobile telephone may be used to provide remote control of such games. If the size of the display were too small to use a touch screen, the system may, in one example embodiment, zoom up the display when the player touches the area so that the controls can be easily accessed. In another example embodiment, a pinball effect could be used to launch multiple games that could interact and share game assets or states.

According to another embodiment, there is provided method and apparatus for scaling between game sponsors or casinos. For example, some game play may be casino specific, while other aspects of a particular game's play may be universal to all casinos or sponsors. Various items that may need to be scaled between casinos include who to credit with a player's play if, for example, it is done using the player's mobile phone and not the casino's equipment, how to scale between any math changes between one casino to another, scaling between different modes of game play that may depend on what casino the player is in. Accordingly, according to one example embodiment, there is provided a master or central database account management function that allows transfer between not just games but across casinos, for example to support persistent state from one casino to another. In one embodiment, this central function provides for scaling and for transferring assets or states instantaneously from one casino to another. In at least one embodiment, accordingly, assets or states may be saved in a master or central database and shared with casinos, which may have their own rules for scaling assets or states obtained in other casinos.

Alternatively, a game state or game assets may be stored in a mobile game or device that is brought by the player from one casino to another. transfer it and the information goes with you wherever you go. Such assets or states may be stored, for example, on a player's mobile phone, particularly if the phone has been used to play a game for which assets or states are transferred. The location of such a mobile phone may be determined based on which cell tower or cell radio the phone was reporting to, and that information may be relayed to a server that can share location information with a casino. In accordance with still another example embodiment, assets or states related to local area progressives may be kept, but if the player leaves the progressive area, they are not able to keep credit, or you may be able to keep the credits. Alternatively, any contributions to a personal progressive may be kept for the player, and the player be allowed to transfer the progressive bet to another machine or game of the same or different type. Or, the player may be allowed to combine personal progressives into one pot or play for another player's pot.

According to another example embodiment, a player may be allowed, using a mobile phone or other hand held, to use the shared assets or states to join a bank of machines participating in a LAP or WAP, wherein the progressive is run on server and virtualizes the experience for the player on his mobile unit. According to this embodiment, a bonus bank may dynamically invite a portable device to join, or if the user of the portable sees that a bank is hot, then the user can initiate a request to join the bank through your portable. In another embodiment, the portable may allow a user to see if someone hit a particular WAP before

Example Wagering Machine

Figure 3:
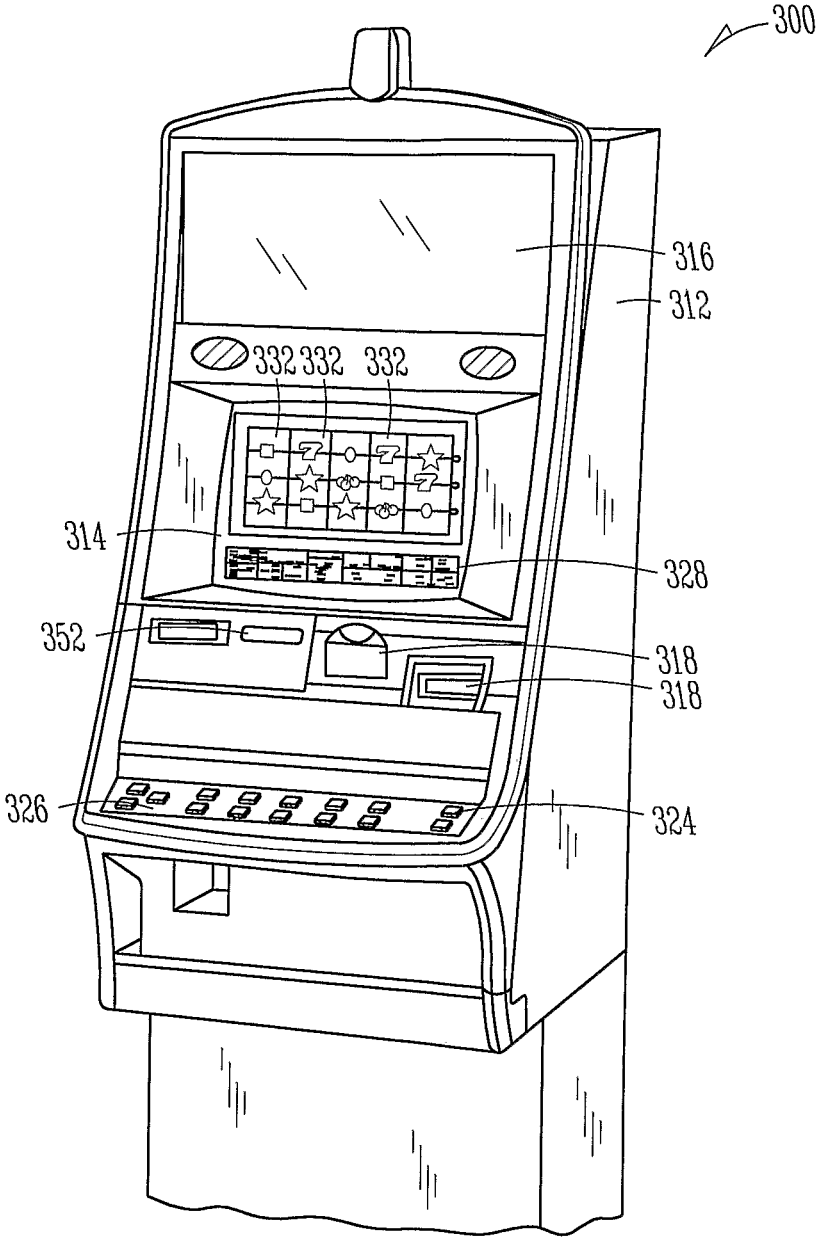
FIG. 3 is a perspective view of an example embodiment of a wagering game machine, according to example embodiments to the inventive subject matter.

FIG. 3 is a perspective view of a wagering game machine, according to example embodiments of the invention. Referring to FIG. 3, a wagering game machine 300 is used in gaming establishments, such as casinos. According to embodiments, the wagering game machine 300 can be any type of wagering game machine and can have varying structures and methods of operation. For example, the wagering game machine 300 can be an electromechanical wagering game machine configured to play mechanical slots, or it can be an electronic wagering game machine configured to play video casino games, such as blackjack, slots, keno, poker, blackjack, roulette, etc.

The wagering game machine 300 comprises a housing 312 and includes input devices, including value input devices 318 and a player input device 324. For output, the wagering game machine 300 includes a primary display 314 for displaying information about a basic wagering game. The primary display 314 can also display information about a bonus wagering game and a progressive wagering game. The wagering game machine 300 may also include a secondary display 316 for displaying wagering game events, wagering game outcomes, and/or signage information. While some components of the wagering game machine 300 are described herein, numerous other elements can exist and can be used in any number or combination to create varying forms of the wagering game machine 300.

The value input devices 318 can take any suitable form and can be located on the front of the housing 312. The value input devices 318 receive currency and/or credits inserted by a player. The value input devices 318 can include coin acceptors for receiving coin currency and bill acceptors for receiving paper currency. Furthermore, the value input devices 318 can include ticket readers or barcode scanners for reading information stored on vouchers, cards, or other tangible portable storage devices. The vouchers or cards can authorize access to a central account, which can transfer money to the wagering game machine 300.

The player input device 324 comprises a plurality of push buttons on a button panel 326 for operating the wagering game machine 300. In addition, or alternatively, the player input device 324 can comprise a touch screen 328 mounted over the primary display 314 and/or secondary display 316. The touch screen 328 can contain soft touch keys denoted by graphics on the underlying primary display 314 and used to operate the wagering game machine 300. The touch screen 328 provides players with an alternative method of input. A player enables a desired function either by touching the touch screen 328 at an appropriate touch key or by pressing an appropriate push button. Touch keys can be used to implement the same functions as push buttons. Alternatively, the push buttons can provide inputs for one aspect of operation, while the touch keys can allow for input needed for another aspect of operation.

The various components of the wagering game machine 300 can be connected directly to, or contained within, the housing 312. Alternatively, some of the wagering game machine's components can be located outside of the housing 312, while being communicatively coupled with the wagering game machine 300 using any suitable wired or wireless communication technology.

The operation of the basic wagering game can be displayed to the player on the primary display 314. The primary display 314 can also display the bonus game associated with the basic wagering game. The primary display 314 can include a cathode ray tube (CRT), a high resolution liquid crystal display (LCD), a plasma display, light emitting diodes (LEDs), or any other type of display suitable for use in the wagering game machine 300. Alternatively, the primary display 314 can include a number of mechanical reels to display the outcome in visual association with at least one payline 332. In FIG. 3, the wagering game machine 300 is an "upright" version in which the primary display 314 is oriented vertically relative to the player. Alternatively, the wagering game machine can be a "slant-top" version in which the primary display 314 is slanted at about a thirty-degree angle toward the player of the wagering game machine 300. In yet another embodiment, the wagering game machine 300 can be a bartop model, a mobile handheld model, or a workstation console model.

A player begins playing the basic wagering game by making a wager via the value input device 318. A player can select play by using the player input device's buttons or touch screen 328. The basic game can consist of a plurality of symbols arranged in an array, and can include at least one payline 332 that indicates one or more outcomes of the basic game. Such outcomes can be randomly selected in response to the wagering input by the player. At least one of the outcomes can be a start-bonus outcome, which can include any variation of symbols or symbol combinations triggering a bonus game.

In some embodiments, the wagering game machine 300 can also include an information reader 352 used for identifying players by reading cards indicating players' identities. The information reader 352 can include a card reader or any suitable device, including a ticket reader, bar code scanner, RFID transceiver, or computer readable storage medium interface. In some embodiments, the information reader 352 can be used to award complimentary services, restore game assets 450 (FIG. 4), track player habits, or provide other functions.

According to one example embodiment, the method and apparatus disclosed herein provide for allowing a player to play the same wagering game on more than one platform and have the game states or assets follow them from one platform to the other platform, or shared between platforms. According to another example embodiment, the method and apparatus disclosed herein provide for allowing a player to play more than one session of the same wagering game on a single platform and have the game states or assets be shared between sessions. According to still another example embodiment, the assets or states may be transferred to or shared with other games that are different than the game in which the states or assets are accumulated. In another example embodiment, states or assets may be transferred between tournaments on multiple different platforms or between games in any type of community gaming.

The following commonly assigned U.S. patent applications are related, and are herein incorporated by reference in their entirety: "Wagering Game Having Rule Set Modification," Ser. No. 11/289,894, filed on Nov. 30, 2005; "Sharing Game Assets In A Wagering Game Network," Ser. No. 60/700,933, filed on Jul. 20, 2005; and "Wagering Game With Changed Game Indicia Over Multiple Gaming Sessions," Ser. No. 60/586,032, filed on Jul. 7, 2004.

Figure 4:
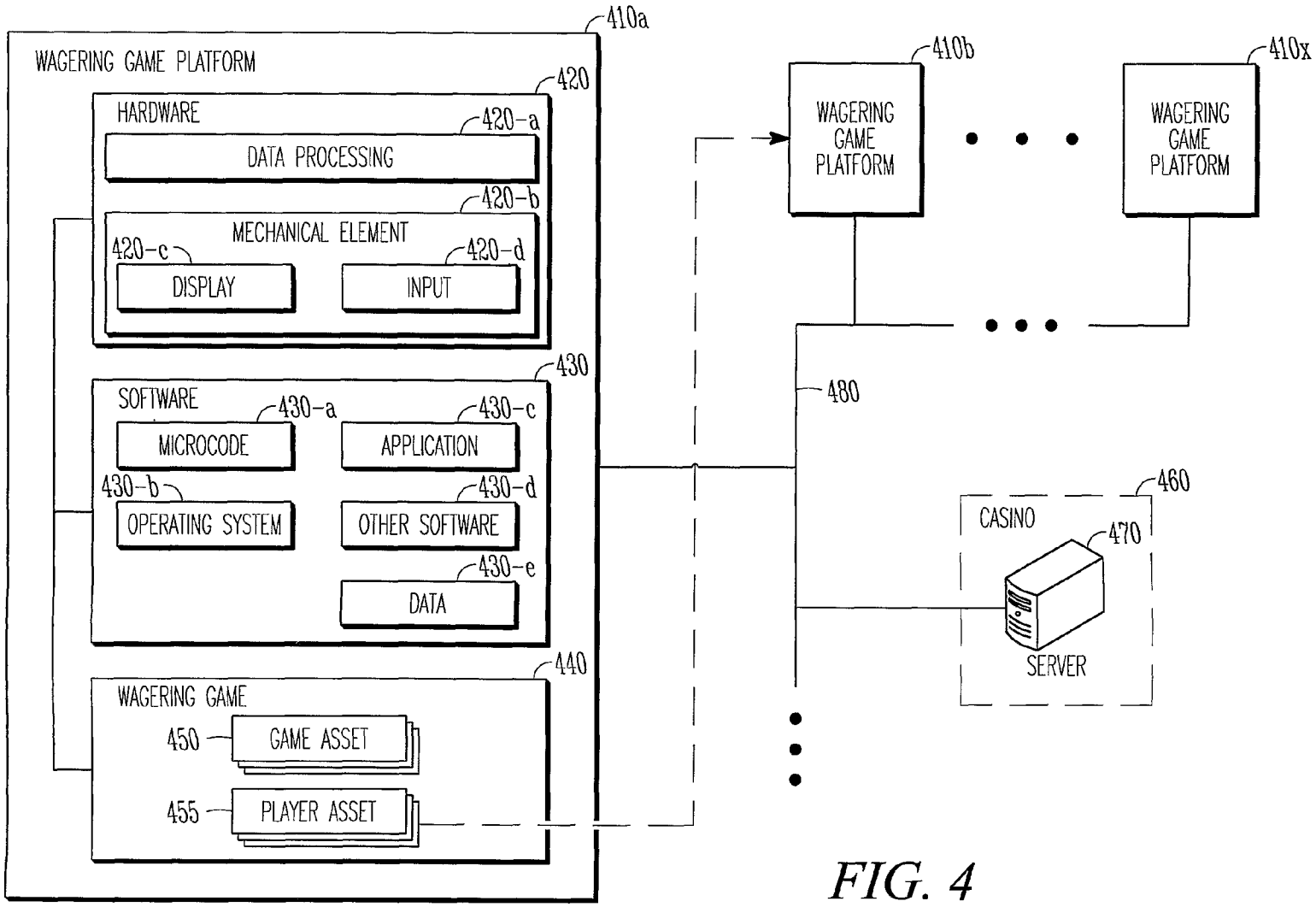
FIG. 4 is a block diagram of gaming platforms according example embodiments to the inventive subject matter.

Referring now to FIG. 4 there is illustrated a first example embodiment 400 of a system and method according to the inventive subject matter. A plurality of wagering game platforms 410*a*, 410*b*, . . . , 410*x* may each include a hardware portion 420 and a software portion 430. Hardware portion 420 includes a data processing platform 420-*a* and one or more mechanical elements 420-*b*, such as a video display 420-*c*, input mechanisms 420-*d*, for example keyboards, keypads, input buttons, a slot machine arm, or other mechanisms. Software portion 430 includes, for example, microprocessor microcode 430-*a*, operating system software 430-*b*, application programs 430-*c*, other software 430-*d*, and data 430-*e*. According to one example embodiment, at least two of platforms 410 include different capabilities such as, but not limited to, different data processing platforms, or data processing platforms operating at different speeds, different operating system software, different application software, or different hardware capabilities such as different display capabilities or input mechanisms. Such platforms 410 may take the form of a mobile telephone, a personal digital assistant, a custom device, a video game handheld device, a casino upright device, a casino table game, a tablet computer, a laptop computer, or a personal computer.

A wagering game 440 is implemented on at least two platforms 410, each with different capabilities. The wagering game 440 may receive a wager in the form, for example, as a wager instruction entered by a player using a button on the input mechanism for the platform 410. The wagering game 440 may be, for example, a video poker game, a reel spinning game, an episodic play game, or any other skill-based or entertainment game. According to one example embodiment, the wagering game 440 further supports a plurality of game assets 450. In some embodiments, game assets 450 are components of a game, such as an image, animation, video clip, sound track or math table. According to another example embodiment, the wagering game 440 supports one or more player assets 455. In certain embodiments, player assets 455 include persistent state assets, where such an asset is used to maintain a game state for a particular player. In certain embodiments, player assets 455 include personalized assets, such as account information. For example, player assets 455 may include assets such as credits earned, cards dealt, a game play level, tokens earned, progress in an episodic game, a buddy list, a previous best score or achievement, or a game play statistic or as may be described in the above referenced patent applications regarding persistent gaming. A player asset 455 may be represented by a particular game asset. For example, a player might collect trophies (player or persistent state assets) over the course of playing a game where the trophies are represented by images of such trophies (game assets) within the game.

Further, the wagering game 440 may be administered by two or more different entities 460, such as a casino entity 460 or any other entity 460 that controls the game 440. Entity 460 may use one or more server computers 470 that may communicate with the wagering game 440 over a wired or wireless network 480. However, a wagering game 440 need not be connected to a network or server computer of the entity 460, but administered only locally by uploading and downloading of programs or other content to the wagering game.

Figure 5:
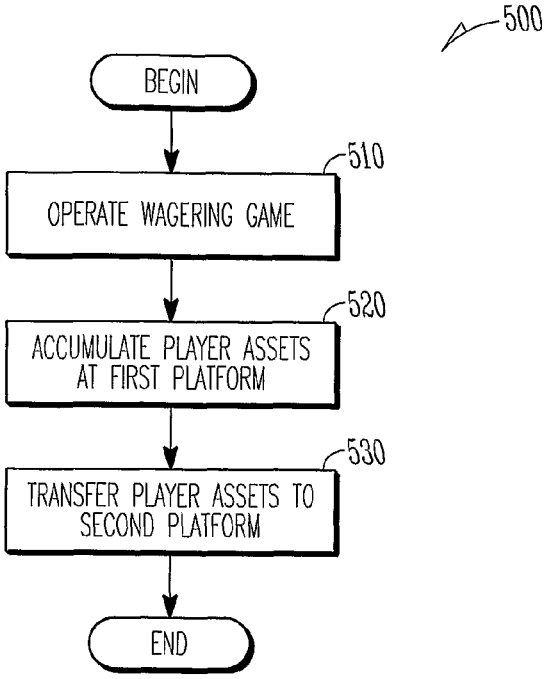
FIGS. 5 and 6 are flowcharts of methods according to example embodiments of the inventive subject matter.

Referring now to FIG. 5, there is illustrated an example embodiment 500 of a method according to the inventive subject matter. Embodiment 500 includes operating 510 a wagering game 440 on one of the platforms 410, wherein the first platform 410*a* is capable of supporting all or fewer than all of a plurality of game assets 450 associated with the wagering game, and further wherein the wagering game 440 is capable of receiving a wager. One or more player assets 455 are accumulated 520 while the wagering game 440 is played on the first platform 410*a*, wherein the player assets 455 may be associated with or owned by, for example, an account held by the player playing the game. One or more of the player assets 455 are transferred 530 to the play of the wagering game 440 on at least one second platform 410*b*. In an embodiment, the second platform 410*b* is capable of supporting all or fewer than all of the plurality of game assets 450. In an embodiment, the first platform 410*a* and the second platform 410*b* differ from one another with respect to at least one capability including but not limited to a display capability, data processing capability, input capability, operating system capability, data storage capability or mechanical component capability.

According to some embodiments, an asset can be advanced in various ways, including gaining experience levels, rank, or titles; or developing an avatar or graphical representation of growth. For example, a player may begin an episodic wagering game at an initiate ranking (e.g., ensign) and as a player progresses through the game, he can accumulate points that trigger a promotion (e.g., ensign to lieutenant, and lieutenant to commander, captain, commodore, and admiral). In another example, a character or avatar in a wagering game can be advanced or developed (e.g., age, grow, change professions) by playing the wagering game. The character or avatar can be represented by one or more game assets 450.

According to another example embodiment, one or more game assets 450 or player assets 455 can be advanced during game play on a first one of the platforms 410, but the manner or degree to which the assets 450, 455 can be advanced on the second platform 410*b* is related to a difference in capabilities of the second platform 410*b*. For example, a player's advancing rank may be depicted by an evolving avatar or insignia on a first platform, however, because of a difference in capability (e.g., graphical or video rendering), on a second platform, the advancement may be depicted by a number of stars (or even asterisks if the second platform is only capable of displaying text).

According to another example embodiment, the first platform 410*a* and the second platform 410*b* differ from one another when at least the first platform 410*a* or second platform 410*b* is not capable of supporting at least one of the plurality of game assets 450 that is supported on the other one of the first platform 410*a* or second platform 410*b*. According to another example embodiment, a difference in capability of platforms 410 precludes at least one of the first platform 410*a* or the second platform 410*b* from supporting a game asset 450 in substantially the same manner as it is supported on the other one of the first platform 410*a* or second platform 410*b*. According to another example embodiment, the different capabilities relate to different user interfaces, touch screen capabilities, reel type (e.g., mechanical or electronic), reel speed or mechanical top box components.

According to still another example embodiment, the display capability of the platform 410 comprises a capability selected from the group of: memory display capacity, display resolution, display size or display speed. According to another example embodiment, the data processing capability of the platform 410 comprises a capability selected from the group of: data processing speed, data processing capacity or type of microprocessor. According to yet another example embodiment, the input capability of the platform 410 comprises a capability selected from the group of: personal computer keyboard, mobile phone keypad, personal digital assistance keypad, mechanical buttons, or touch-screen input.

Figure 6:
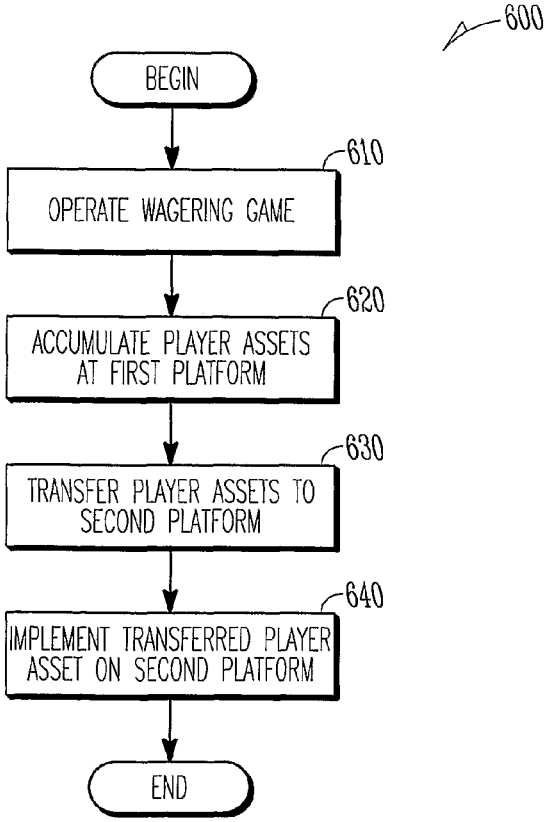

Referring now to FIG. 6, there is illustrated another example embodiment 600 of a method according to the inventive subject matter. Embodiment 600 includes operating 610 a wagering game 440 on one of platforms 410, wherein the first platform 410*a* is capable of supporting all or fewer than all of a plurality of game assets 450 associated with the wagering game, and further wherein the wagering game 440 is capable of receiving a wager. One or more player assets 455 are accumulated 620 while the wagering game 440 is played on the first platform 410*a*, wherein the player assets 455 may be associated with the game and the player playing the game. One or more of the player assets 455 are transferred 630 to the play of the wagering game 440 on at least one second platform 410*b*, wherein the second platform 410*b* is capable of implementing fewer than all of the plurality of game assets 450 in the same manner as the first platform 410*a*, or not capable of supporting the game asset 450 at all. Further, at least one of the game assets 450 is implemented 640 differently on the second platform 410*b* than on the first platform 410*a* as a result of at least one difference in the capabilities of the first platform 410*a* and the second platform 410*b*. According to this embodiment, the first platform 410*a* and the second platform 410*b* differ from one another with respect to at least one capability, for example but not limited to display capability, data processing capability, input capability, operating system capability, data storage capability or mechanical component capability. According to still another example embodiment, the difference in the capability between the first platform 410*a* and the second platform 410*b* is an absence of the corresponding capability in the other platform, or the difference in the capability between the first platform 410*a* and the second platform 410*b* is a reduction in the corresponding capability in the other platform.

In still another example embodiment, at least one of the game assets is implemented to require a first input capability, and wherein the difference in implementation is using a different input capability on the other platform. In another example embodiment, at least one of the game assets is implemented using a first data processing capability, and wherein the difference in implementation is using a different data processing capability on the other platform.

In yet still another example embodiment, at least one of the player assets 455 may include one or more of: credits earned, cards dealt, a game play level, tokens earned, progress in an episodic game, a buddy list, a previous best score or achievement, or a game play statistic.

According to one more example embodiment, a feature of the wagering game 440 is implemented on the first platform 410*a* and the same feature is implemented on the second platform 410*b* by simulating the feature where the capabilities required to implement the feature in the same way on the second platform 410*b* are not available in the second platform 410*b*. In some embodiments, a feature includes, but is not limited to, display capability, data processing capability, input capability, operating system capability, data storage capability or mechanical component capability of a platform 410. In yet another example embodiment, the first platform 410*a* and the second platform 410*b* differ from one another wherein at least one of the first platform 410*a* or second platform 410*b* is not capable of supporting at least one of the plurality of game assets 450 that is supported on the other one of the first platform 410*a* or second platform 410*b*.

According to another example embodiment, the first platform 410*a* or the second platform 410*b* may include one or more of: a mobile telephone, a personal digital assistant, a custom device, a video game handheld device, a casino upright device, a casino table game, a tablet computer, a laptop computer, or a personal computer.

According to yet another example embodiment, at least some of the game assets 450 are supported using at least one of the capabilities of the game platforms 410. Still further, according to yet another example embodiment, the display capability comprises a capability selected from the group of memory display capacity, display resolution, display size or display speed, the data processing capability comprises a capability selected from the group of data processing speed, data processing capacity or type of microprocessor, and the input capability comprises a capability selected from the group of personal computer keyboard, mobile phone keypad, personal digital assistance keypad, mechanical buttons or touch-screen input.

In yet another example embodiment, a difference in capability precludes at least one of the first platform 410*a* or second platform 410*b* from supporting the game asset 450 that is supported on the other one of the first platform 410*a* or second platform 410*b*, or a difference in capability precludes at least one of the first platform 410*a* or second platform 410*b* from supporting the game asset 450 in substantially the same manner as it is supported on the other one of the first platform 410*a* or second platform 410*b*.

Figure 7:
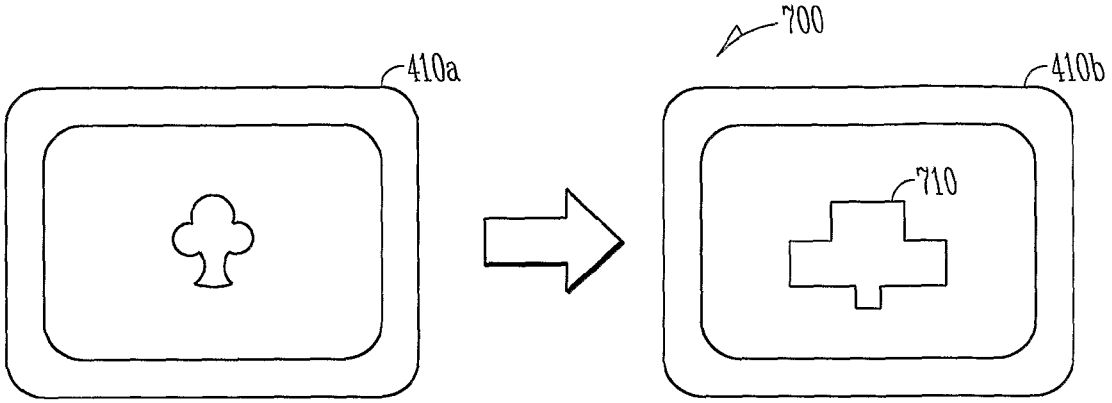
FIGS. 7-14 are illustrations of corresponding implementations on two gaming platforms according to example embodiments of the inventive subject matter.
Figure 8:
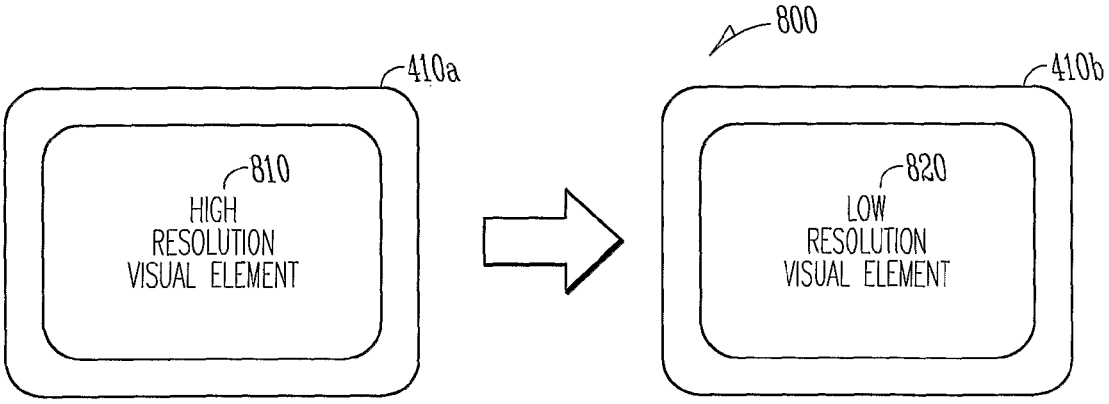
Figure 9:
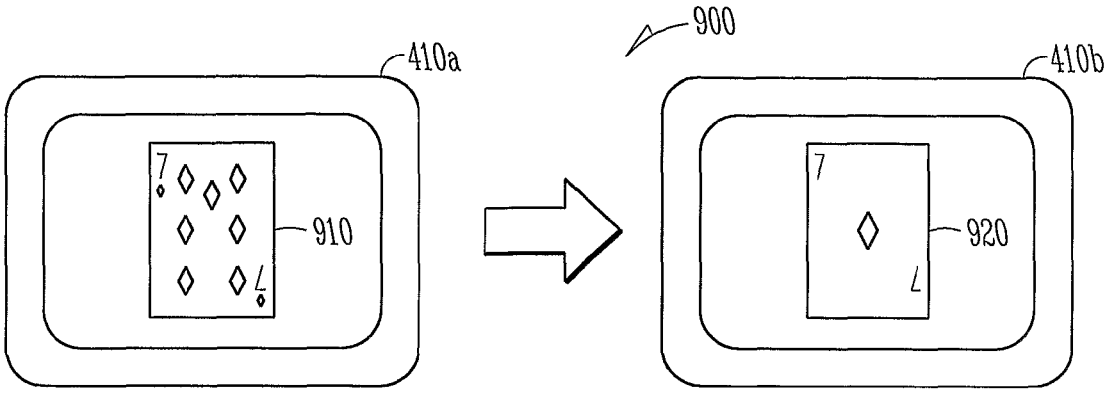

According to another example embodiment 700 illustrated in FIG. 7, the second platform 410*b* has lesser display capability than the first platform 410*a*, and a visual element 710 of the wagering game 440 is represented on the second platform 410*b* with a similar but not identical representation. In a still further example embodiment, the implementation on the first platform 410*a* uses a first level of resolution for rendering video elements, and the corresponding implementation on the second platform 410*b* uses a second level of resolution that is less than the first level for rendering the video elements. In yet another example embodiment 800 illustrated in FIG. 8, at least one of the game assets 450 is implemented as a displayed visual element 810, and wherein the difference in implementation is a reduction in the resolution of the displayed visual element 820. In another example embodiment 900 illustrated in FIG. 9, the similar but not identical representation reduces a relatively complex pictorial item 910 to a relatively less complex pictorial item 920 on the second platform 410*b*. In still another example embodiment, a pictorial element's representation is adjusted to an alphanumeric representation.

Figure 10:
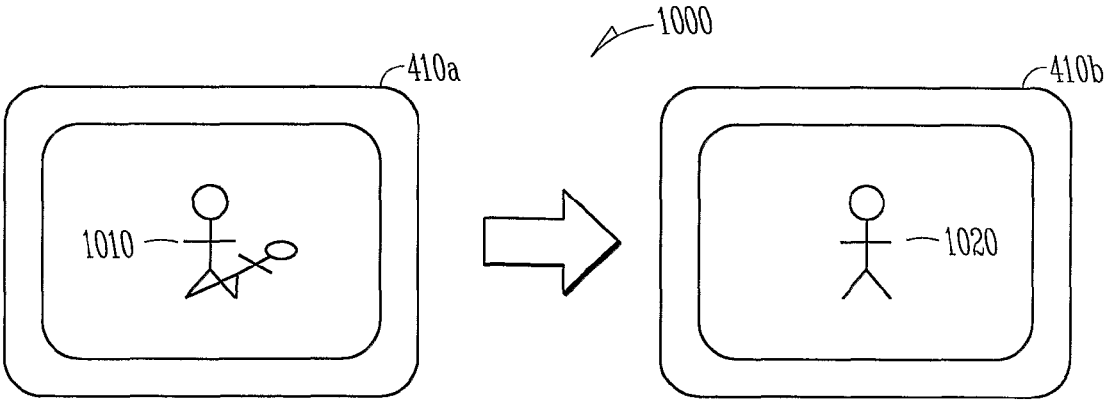

In yet another example embodiment 1000 illustrated in FIG. 10, the implementation on the first platform 410*a* uses a first technique 1010 (e.g., shadowing) for rendering video elements, and the corresponding implementation 1020 on the second platform 410*b* uses a second technique for rendering the video elements. According to still another example embodiment, the second technique involves reducing at least one aspect of detail such as color, resolution, shadows, polygon count or particle effects, or the implementation on the first platform 410*a* uses a first technique for rendering video elements, and the corresponding implementation on the second platform 410*b* uses a second technique for rendering the video elements, wherein the second technique pre-processes certain video elements to reduce the real-time processing required to handle the video element on the second platform 410*b*.

Figure 11:
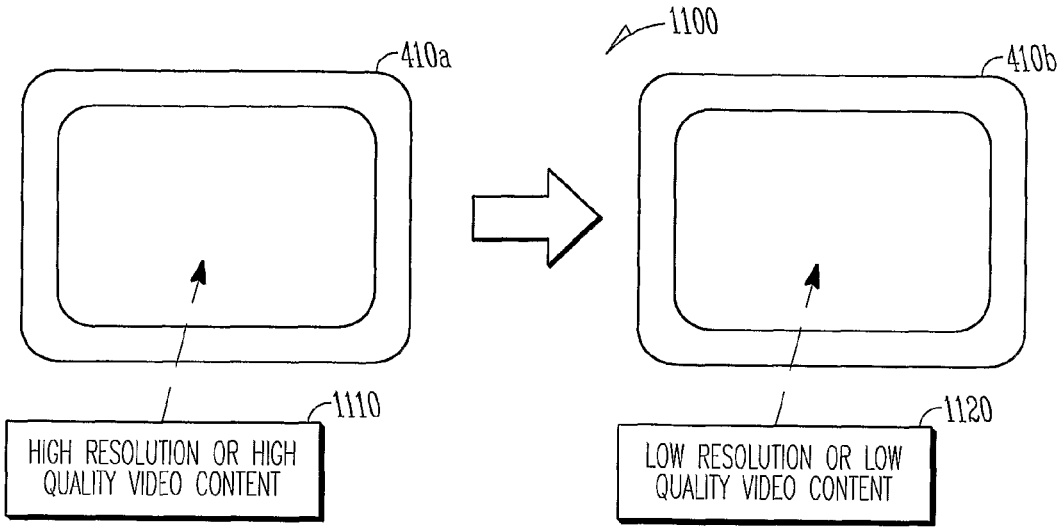
Figure 12:
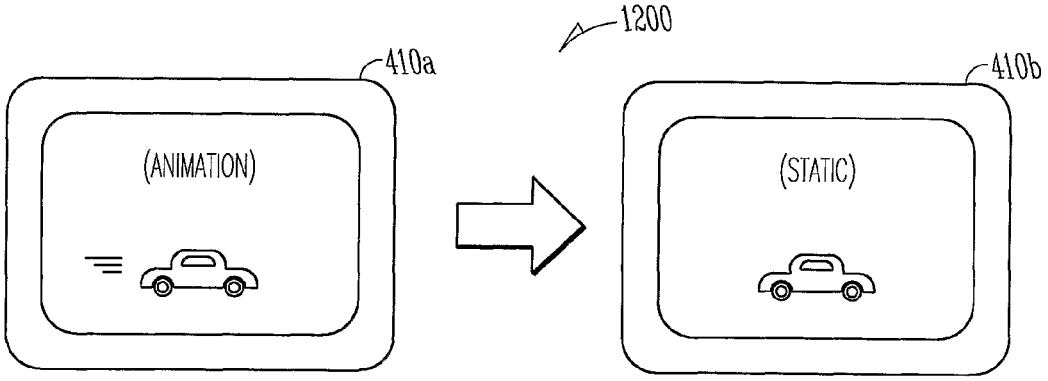

In yet another example embodiment 1100 illustrated in FIG. 11, the implementation on the first platform 410*a* uses a first source of video content 1110 for rendering video elements, and the corresponding implementation on the second platform 410*b* uses a second source of video content 1120 for rendering the video elements. Or, in another alternative embodiment 1200 illustrated in FIG. 12, the implementation on the first platform 410*a* uses animated video elements 1210, and the corresponding implementation on the second platform 410*b* uses static video elements 1220.

Other alternative embodiments may provide the implementation on the first platform 410*a* using a first technique for rendering audio elements, and the corresponding implementation on the second platform 410*b* using a second technique for rendering the audio elements. In still a further example embodiment, the implementation on the first platform 410*a* uses a stereophonic, broadband, or multi-channel technique for rendering audio elements, and the corresponding implementation on the second platform 410*b* uses a monophonic technique for rendering the audio elements.

Figure 13:
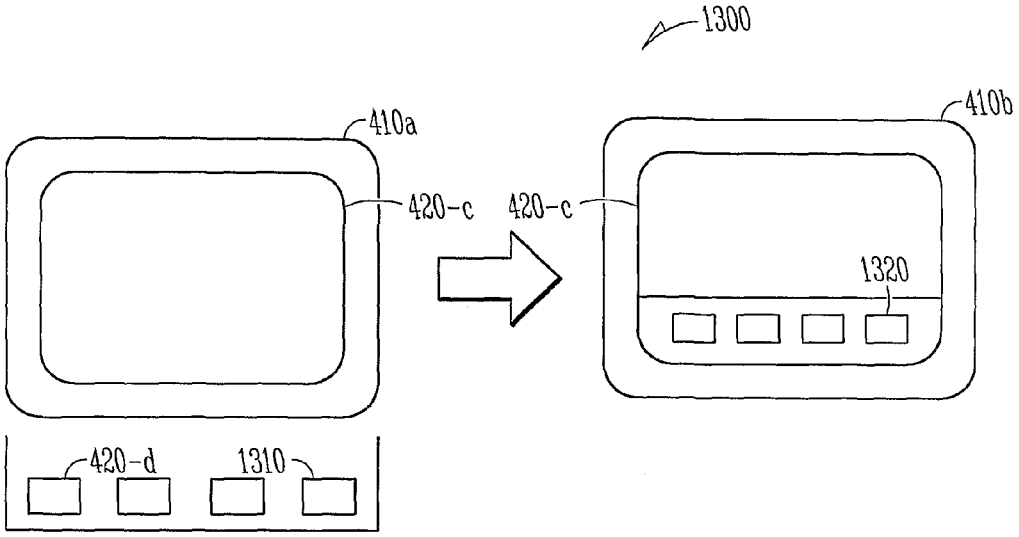

In still another example embodiment 1300 illustrated in FIG. 13, an implementation 1310 on the first platform 410*a* uses a mechanical device 420-*d*, and the corresponding implementation 1320 on the second platform 410*b* simulates the mechanical device using a video display 420-*c*.

Figure 14:
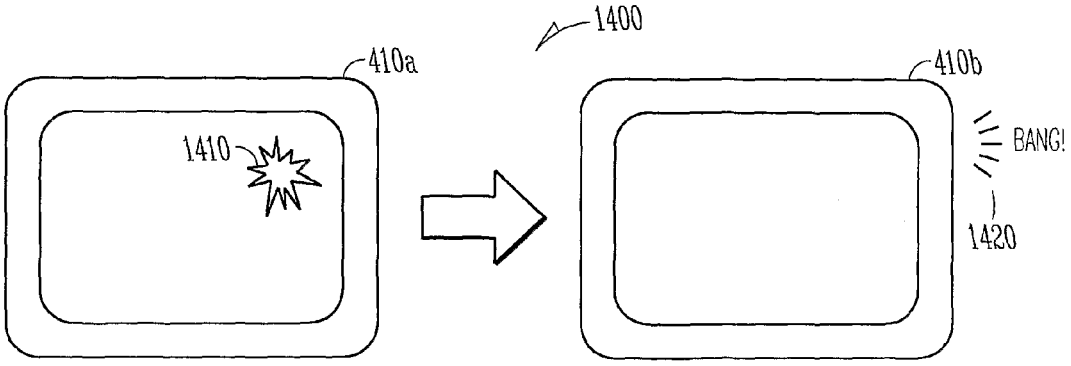

In still yet another example embodiment 1400 illustrated in FIG. 14, the implementation 1410 on the first platform 410*a* uses a video element, and the corresponding implementation 1420 on the second platform 410*b* uses an audio element. Or, the implementation on the first platform 410*a* uses an audio element, and the corresponding implementation on the second platform 410*b* uses a video element.

Figure 15:
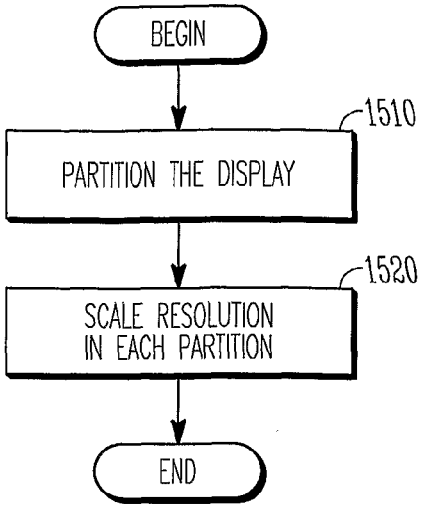
FIGS. 15-17 are flowcharts of methods according to example embodiments of the inventive subject matter.

In one other example method embodiment 1500 illustrated in FIG. 15, the second platform 410*b* is formed by partitioning 1510 at least the video display of the first platform 410*a* into two display areas wherein each display area is smaller than the display area for the wagering game 440 when implemented on the full video display, one for each instance of the wagering game 440, and further wherein the video elements are scaled 1520 down in resolution for both instances of the wagering game 440 in the reduced video display areas.

Figure 16:
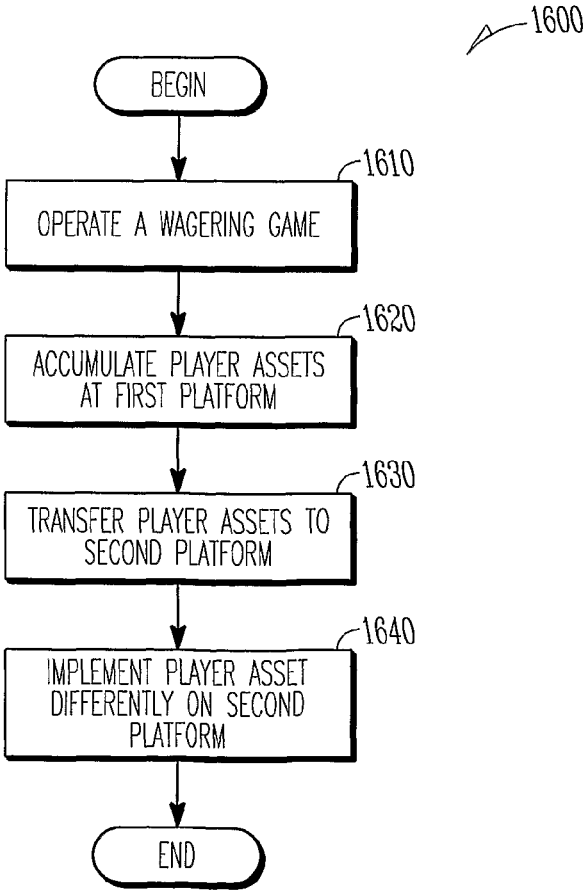

Referring now to FIG. 16, there is illustrated another example embodiment 1600 of a method according to the inventive subject matter. Embodiment 1600 includes operating 1610 a wagering game 440 on one of platforms 410 wherein the wagering game 440 is administered by at least one first entity 460, for example but not by requirement located in a first location. One or more player assets 455 are accumulated 1620 while the wagering game 440 is played on the first platform 410*a*, wherein the player assets 455 may be associated with the player playing the game. One or more of the player assets 455 are transferred 1630 to the play of the wagering game 440 on at least one second platform 410*b*, wherein the second platform 410*b* is administered by a second entity 460 that is different than the first entity. In one alternative embodiment, the second platform 410*b* may be located in a second location different than the first location, such as at a different casino. In another example embodiment, the second platform may also be capable of implementing fewer than all of a plurality of game assets 450 in the same manner as the first platform 410*a*, or not capable of supporting one of the game assets 450 at all. Further, at least one of the transferred player assets 455 is implemented or treated 1640 differently on the second platform 410*b* than on the first platform 410*a* as a result of at least one difference in the respective policies for handling player assets 455 between the first entity 460 and second entity 460. According to another embodiment, the implementation may be also different as a result of at least one difference in the capabilities of the first platform 410*a* and the second platform 410*b*.

According to one example embodiment, the policy of one entity 460 awards a particular player more assets for the same play as the policy of the other entity 460. According to another example embodiment, the policy of one of the entities is different from the policy of the other one of the entities based on the status of a player relative to the entity 460. In still another example embodiment, the player asset 455 is implemented or treated differently based on differences in the way each entity 460 sets or determines odds.

Figure 17:
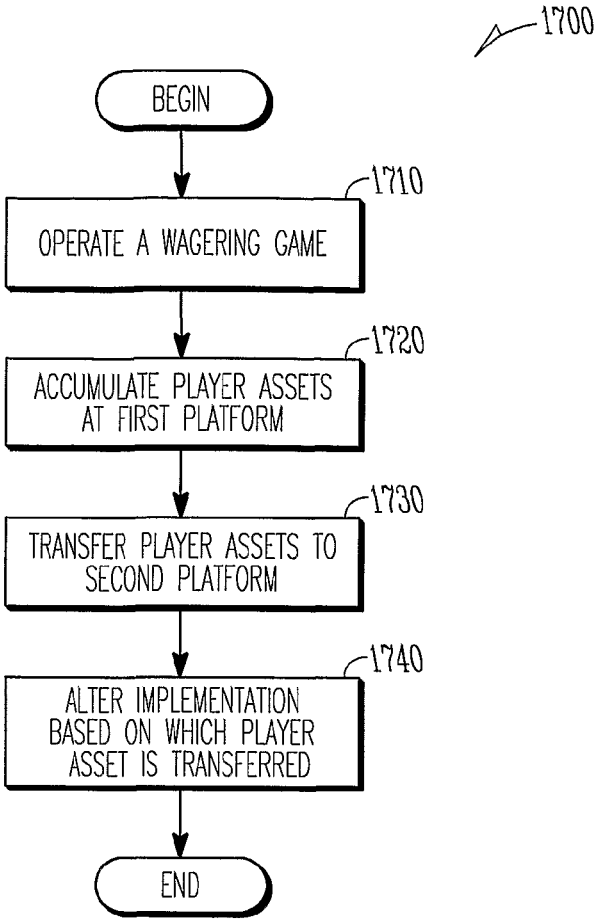

Referring now to FIG. 17, there is illustrated an example embodiment 1700 of a method according to the inventive subject matter. Embodiment 1700 includes operating 1710 a wagering game 440 on one of platforms 410, wherein the first platform 410*a* is capable of supporting all or fewer than all of a plurality of game assets 450 associated with the wagering game, and further wherein the wagering game 440 is capable of receiving a wager. One or more player assets 455 are accumulated 1720 while the wagering game 440 is played on the first platform 410*a*, wherein the player assets 455 may be associated with the game and the player playing the game. One or more of the player assets 455 are transferred 1730 to the play of the wagering game 440 on at least one second platform 410*b*, wherein the second platform 410*b* is capable of supporting all or fewer than all of the plurality of game assets 450, and wherein the first platform 410*a* and the second platform 410*b* differ from one another with respect to at least one capability including but not limited to a display capability, data processing capability, input capability, operating system capability, data storage capability or mechanical component capability. Further, the implementation 1740 of the wagering game 440 on the second platform 410*b* may change in response to which ones of the player assets 455 that are transferred to it from the first platform 410*a*. For example, the second platform may implement fewer than all transferred player assets 455 if the second platform is not capable of implementing all the transferred assets, or may reduce the scaling of one or more game assets 450 if there are too many assets to support for the capability of the platform, such as reducing the video display capabilities or eliminating secondary features of the wagering game 440.

Figure 18:
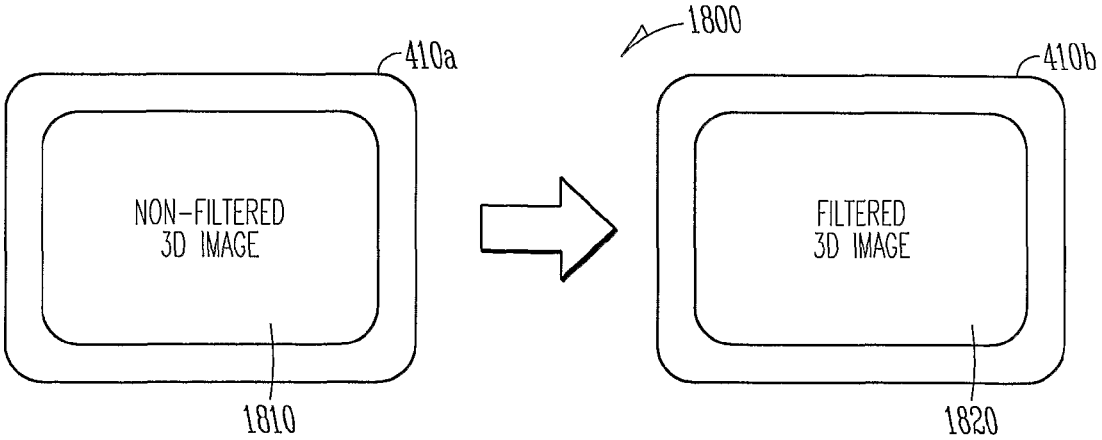
FIGS. 18-20 are illustrations of corresponding implementations on two gaming platforms according to example embodiments of the inventive subject matter.

In yet another example embodiment 1800 illustrated in FIG. 18, the implementation on the first platform 410*a* uses a first technique 1810 for rendering and filtering 3D video elements, and the corresponding implementation 1820 on the second platform 410*b* uses a second technique for rendering and filtering the 3D video elements. According to other example embodiments, the second technique for rending the video elements includes the use of full-screen anti-aliasing (FSAA) or anisotropic filtering.

Figure 19:
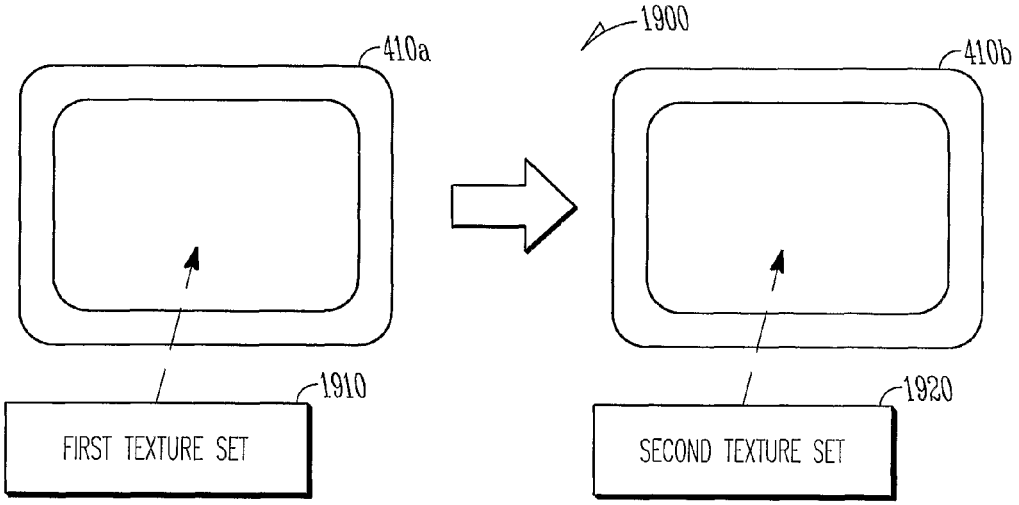

In another example embodiment 1900 illustrated in FIG. 19, the implementation on the first platform 410*a* uses a first set of textures 1910 for the 3D video elements, and the corresponding implementation on the second platform 410*b* uses a second set of textures 1920 when rendering the 3D elements.

Figure 20:
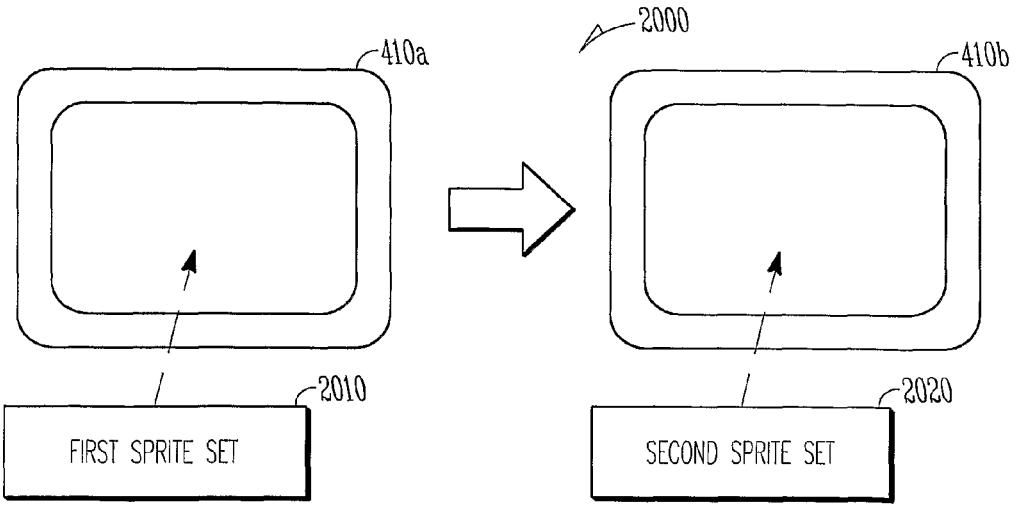

In still another example embodiment 2000 illustrated in FIG. 20, the implementation on the first platform 410*a* uses a first set of sprites 2010 for the video elements, and the corresponding implementation on the second platform 410*b* uses a second set of sprites 2020.

Figure 21:
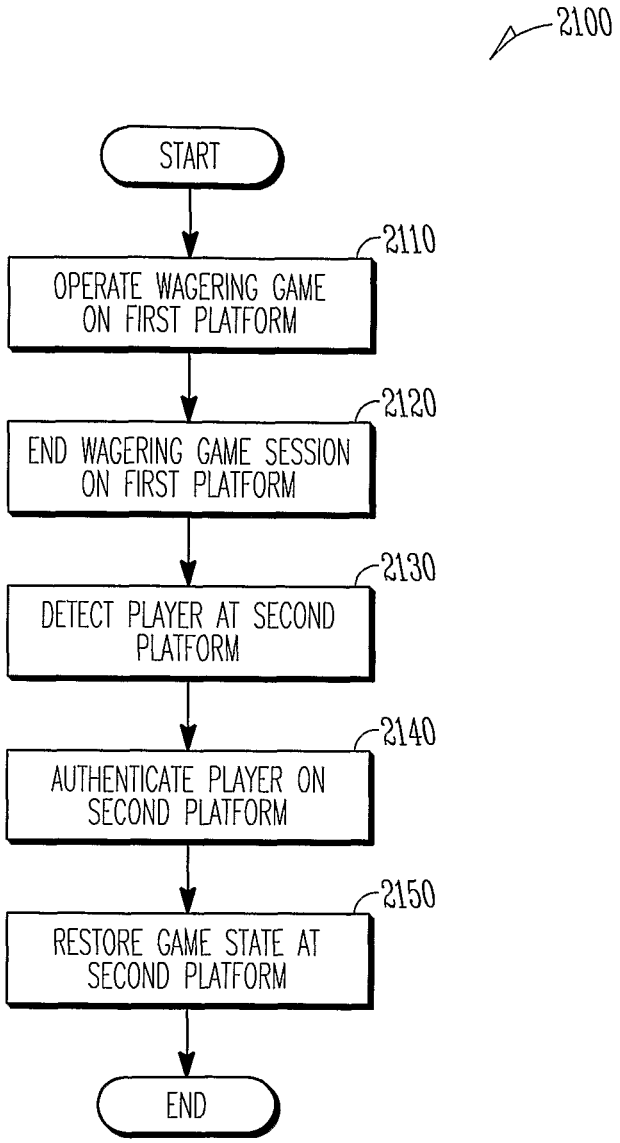
FIG. 21 is a flowchart of a method according to an example embodiment of the inventive subject matter.

According to another example embodiment, the system and method provides for authentication or identification of the player on each platform 410 to allow the state or assets to be transferred between platforms or sessions. Instant authentication between games running on different platforms may be accomplished with biometric identification, such as a biometric handheld device, or authentication or at least identification of a user can be done using a player tracking card or a user name/password combination. FIG. 21 illustrates a method 2100 for authenticating a user as he moves from platform to platform. In an example embodiment 2100, a user operates a wagering game on a first platform 2110 and when he decides to move to a different platform, he can end his gaming session 2120 by, for example, logging out of the current game. At the second platform, systems and methods detect him 2130 and use one or more authentication operations 2140 to authenticate his identity. For example, to resume play at the second platform, a player may interact with an on-screen user interface to indicate that he wants to continue a saved game. In other examples, systems and methods may automatically detect the player's presence, such as by using wireless communication to detect a player identification card (i.e., RFID tag). Once the user is authenticated at the second platform, the user's game session state can be restored 2150 and his play can resume from the point it left off at the first platform.

According to still another example embodiment, when switching sessions or platforms of a game, the players have an opportunity to identify a prior session they wish to resume or to share their assets or states with. This may be accomplished, for example, by showing the user a list of prior play sessions that they can choose to resume.

According to still another example embodiment, once a user is identified at a gaming machine, the machine may reconfigure itself and in one example embodiment personalize itself to the player and continue a game that was terminated at another gaming machine or possibly still in play on another device. According to one example embodiment, the platforms 410 may include a slot machine, a mobile telephone platform, a PDA platform, a personal computer platform, or other platforms. Game states or player assets 455 may include, without limitation, credits earned or awarded on a machine, cards dealt in a hand not yet completed, a play status achieved, such as a level achieved in a game with multiple levels of achievement, or tokens or other items awarded to the player that can be transferred to another platform 410 or session and used. In another embodiment, levels or boards or stages achieved in episodic games can be transferred from one platform 410 or session to another. According to still another embodiment, there may be player assets 455 that are unique to a particular game that can be accumulated in a master set of assets. There may also be assets that are common to different games that can be used in different games. In addition, assets may include a buddy list, a previous best or other game play statistics. Further, if a player loses at a device, he or she may not lose all player assets 455.

According to another example embodiment, there is provided a method and apparatus to run multiple sessions of same game and share player assets 455 between sessions in parallel or simultaneously, or in a serial fashion. When shared in a serial fashion, the game play is kept in a persistent state when transferred from one platform 410 or session to another. According to still another example embodiment, the system and method provide for maintaining an account for the player, and saving states and assets to the player's account. For example, if the player does not cash out of a machine, the system may automatically save the states or assets. For another example, if a certain amount of time has elapsed with no game play, the system and method may automatically credit the states or assets to the player's account and allow them to restart the machine with those assets or states at a later time.

The system and method may also allow the player to make a claim to a game or platform 410, to allow them to return to the same game at a later time and put more money in or use the credits already accumulated on the game. In another example embodiment, there are provided certain assets that a player may collect on a first game, but have to use or cash out on another device, in order to encourage the player to try other games. In another example embodiment, some player assets 455 can only be advanced on one type of platform or game, but transferred to another platform or game. For example, the same game may be available for play on two or more platforms, such as a full sized casino slot machine and a mobile telephone, wherein in the case of one platform 410 not all the game features available on the other platform 410 are possible, for example because of a lack of peripherals such as a set top unit, or because of lack of video resolution or speed. According to another example embodiment, there may be assets that can be replicated or duplicated onto a second session of a game. In one embodiment, assets to be transferred are player assets 455 that do not have a cash or prize value.

Thus, certain features that can earn credits or assets or produce a certain state in one instance of a game on a first platform 410*a* may not be available when the game is transferred to another instance of the game on a more limited platform 410. For instance, the resolution of a mobile telephone display may be much more limited than the display of a full sized personal computer or free stranding slot or video poker machine. In such cases, according to one example embodiment, the method and system may provided for representing the same elements of a game on the lesser capable video device with similar but not identical representations, for instance an elaborate pictorial item on one game implementation on a high resolution or large display may be represented by a letter or an icon on a low resolution or small display. There are various differences in platforms that may be accommodated, for example such platforms may include handhelds such as phones, PDAs, custom devices, video game handhelds, casino uprights, casino table games, tablet computers, or personal computers in casino hotel rooms. These platforms may all have different capabilities relating to different user interfaces, touch screen capable or not, mechanical reels or speed of reels, mechanical top box components and others. These features may be simulated or recreated on less capable platforms, for example by slowing the speed of play to accommodate slower processing power or using letters and not spinning reels. Free-standing slot machines (e.g., Bluebird® by WMS Gaming, Inc.) can be translated to video on a handheld, for example simulation of mechanical (e.g., the manner in which spinning can be started) or other top box features.

According to another embodiment, SMS short messaging or any other messaging protocol may be used to send someone a text message to tell a player when a new episode is up to play on a game with episodic play. Such may be provided with auto-updates to a free-standing slot machine chassis (e.g., Bluebird®) and to a mobile phone when it happens.

In another embodiment, the phone or Bluebird® enables the mobile phone to do something it cannot do otherwise, for example the player can play a free-standing slot machine and get an advantage in the mobile phone game. According to another example embodiment of the disclosed subject matter, there are various modes of sharing assets possible. For example, a player may open up different sessions, e.g., three sessions that all contribute to one master set of player assets 455. Credits could be pooled across all sessions on different or the same platform 410. A player may be able, in another example embodiment, to use one account or two accounts and share assets between them. For example, the player may have two player tracking cards both tied to the same account. Further, player credits may also be scaled across platforms or sessions. For example, a virtual economy concept may be used wherein something that is worth one amount or value in one game is potentially a worth different value in a different game. For instance, if one game earns free spins, the other may earn a free selection, and one free spin may be worth two free selections, or the same number of selections. According to still another embodiment, market based gaming concepts may be used to encourage folks to move between different types of devices or games like the Big Event® game. According to yet another example embodiment, if a player is wagering on multiple machines, the casino may increase the odds for the player and allow assets or states to be shared. For example, auto-playing multiple accounts may provide a higher percentage chance of winning, or double eligibility may be used to get higher multipliers for odds. In addition, according to another example embodiment, the rate at which the player plays, i.e., coin in, affects the player's ability to transfer assets or states to another session or machine. At a relatively higher coin-in rate, such transfer may be allowed to a game that is more eligible for bonuses, i.e. to a game that the player has a chance to win more on than the game they are currently playing. Thus, this acts as an incentive to accelerate gaming on some games as the player is influenced to increase coin-in rates to enable them to transfer assets to a different device where they may continue gambling longer or in greater amounts.

According to another example embodiment, there is provided a method and apparatus to avoid a race condition between multiple sessions played by a single player simultaneously, to prevent, for example, the player drawing on credits on a first session from a pool wherein another session has spent all credits in the pool before the first session becomes aware. According to one embodiment, all simultaneous sessions may be supported by the same server or synchronized servers, such that credits have to taken from the server and it is not possible for the server to get out of synchronization. According to another example embodiment, a synchronization mechanism is provided to prevent more than one game drawing on pooled credits simultaneously.

According to still another example embodiment, there is provided a method and apparatus for scaling game assets 450 or features between platforms, such as between mechanical and video, between video resolutions, between sound capabilities, between speed differences, between peripheral differences and between other differences. Game play scaling may include scaling between capabilities available on one platform 410 but not available on another, or a capability less available on one platform 410 vs. another. The scaling of games between platforms, may, in one example embodiment, scale assets 450 from machine to machine that might not automatically scale but instead different content is provided for each platform 410. In some embodiments, assets 450 might not be automatically scaled by the platform 410, instead content having different scale factors may be provided to each platform 410. In addition, there may not necessarily be the exact same math or calculations between games but such may be tailored for each device. According to one example embodiment, a game may be custom scaled for each device on which it is available. In still another example embodiment, tools to scale assets may include a smart content tool that creates a translation matrix that provides a key in all the different languages and artwork for the various levels of detail, and script language to do automatic scaling.

According to still further embodiments, scaling game assets 450 may take the form of abstracting the game from the display. For example, animations can be abstracted from actual content. Abstract identifiers can make calls (e.g., generic calls) and represent different things on different devices. In other embodiments, a device can indicate its capabilities to provide automated scaling of assets or features. In other embodiments, for example, when comparing free-standing machines and hand held devices, providing three-dimensional (3D) models can ease scaling, using the same processing but different resolution of display can also ease scaling, or conversely using different processing and a different display may also provide for more flexible scaling. Other types of scaling may include high resolution graphics that scale, animated vs. static elements, full transitions vs. simple or no transitions, stereo or broadband audio vs. monophonic audio, and adaptive timing between animations based on the capabilities of the platform.

In another example embodiment, 3D graphics are scaled to 2D graphics for a mobile phone or PDA application. In another alternate embodiment, a video in one system is scaled to audio in another system, for example, displaying a video of a coin-in compared to representing a coin-in as a beep. Or, in another embodiment, scaling may be accomplished by reducing various aspects of detail such as color, resolution, shadows, particle effects, or changing such things as explosive effects to the use words such as "boom" instead. In addition, certain graphics may be pre-processed to speed display time from one machine to another, such as pre-creating polygonal objects vs. real-time calculation in an engine.

According to another embodiment, a compression scheme is used to scale images to be smaller, such that they looked like the same thing as the larger scale but tinier and when decompressed made to look bigger. According to one example embodiment, accordingly, images may be automatically scaled using auto-scaling software. Further, according to one embodiment, a DSP circuit may be used to perform scaling in real-time. In another embodiment, game assets 450 may be scaled in real-time, but selected from alternative assets according to the display abilities of the game platform 410. According to another example embodiment, a game is scaled in order to accommodate differences in speed between different platforms. For example, in Internet gaming, systems may use a web browser with similar capabilities, but the speed of a particular machine may affect how the game works. In such cases, the example method and apparatus may provide for changing the level of detail in real-time in hardware or software. According to still another example embodiment, a user may be allowed to set the level of detail or other features to assist in scaling the game to the user's particular computing platform 410. For example, the user may dial up or down (i.e., adjust) play features, for example specifying a silent background, or small or large font, or the type of input device is available—i.e., mouse vs. keypad on mobile phone.

According to still another example embodiment, scaling may be used to show multiple sessions at the same time on the same platform 410. For example each session may be scaled down for display, for example to show play of multiple sets of reels. In such a case, this may be a window of a server-based game wherein the player keeps adding games in windows until the resolution remaining is too low to support play. For example, the player may run multiple simultaneous poker games, for example as many as sixteen or more. Such games may share assets such as draw cards or wild cards or other assets. According to still another example embodiment, multiple games may be controlled by one device, for example one set of credit meters could have master controls to spin all, or controls may be slaved together so the player can spin from one and make them play together in synchronized fashion, or a mobile telephone may be used to provide remote control of such games. If the size of the display is too small to use a touch screen, the system may, in one example embodiment, zoom in on the display when the player touches the area so that controls can be easily accessed. In another example embodiment, a "pinball effect," wherein for example items on a display move and ricochet or bounce off each another, could be used to launch multiple games that could interact and share assets or states.

According to another embodiment, there is provided a method and apparatus for adjusting game behavior or characteristics between game sponsors or casinos. For example, some game play may be casino specific, while other aspects of a particular game's play may be universal to all casinos or sponsors. Various items that may need to be adjusted between casinos include who to credit with a player's play if, for example, it is done using the player's mobile phone and not the casino's equipment, how to scale between any math changes between one casino to another, scaling between different modes of game play that may depend on what casino the player is in. Accordingly, in one example embodiment, there is provided a master or central database account management function that allows transfer between not just games but across casinos, for example to support persistent state from one casino to another. In one embodiment, this central function provides for scaling and for transferring assets or states immediately from one casino to another. In at least one embodiment, accordingly, assets or states may be saved in a master or central database and shared with casinos, which may have their own rules for scaling assets or states obtained in other casinos. In at least one other embodiment, assets or states may be saved in a master or central database and shared with entities other than casinos, which may have their own rules for scaling assets or states obtained from other entities.

According to one example embodiment there is provided a method of determining which casino's policy takes precedence. For example, a player may have an "elite" status at one casino and earn assets at a higher rate than at another. If the platform is a mobile phone, such mobile phone may, for example, determine which casino policy is applicable by reference to a server that tracks the location of the mobile phone, for example from information provided by a mobile phone company, by information provided by the player, or by other means such as a blue tooth location device located in the casino that may communicate with the mobile phone to provide location information that can be fed from the mobile phone to a gaming server.

Alternatively, a game state or player assets 455 may be stored in a mobile game or device that is brought by the player from one casino to another. Such assets or states may be stored, for example, on a player's mobile phone, particularly if the phone has been used to play a game for which assets or states are transferred. The location of such a mobile phone may be determined based on which cell tower or cell radio the phone was reporting to, and that information may be relayed to a server that can share location information with a casino. In accordance with still another example embodiment, assets or states related to local area progressives (LAP) may be kept, but if the player leaves the progressive area, they are not able to keep credit, or they may be able to keep the credits. Alternatively, any contributions to a personal progressive may be kept for the player, and the player be allowed to transfer the progressive bet to another machine or game of the same or different type. Or, the player may be allowed to combine personal progressives into one pot or play for another player's pot.

According to another example embodiment, a player may be allowed, using a mobile phone or other portable device, to use the shared assets or states to join a bank of machines participating in a LAP or WAP, wherein the progressive is run on server and virtualizes the experience for the player on his or her mobile unit. According to this embodiment, a bonus bank may dynamically invite a portable device to join, or if the user of the portable device sees that a bank of machines is hot, then the user can initiate a request to join the bank through their portable device. In another embodiment, the portable device may allow a user to see if someone hit a particular WAP before and then transfer assets to the bank and join the WAP.

Transient play behavior allows a player to play the same wagering game on any platform 410, move from one platform to another, and have the player's assets 455 (e.g. personalization, persistent state, collection, and virtual economy qualities) instantly follow the player from platform to platform (e.g., from a traditional slot machine, to a cell phone, to a PC, etc.) regardless of the physical device being used. In other words, the player is instantly authenticated as he moves between devices and his play is non-device specific.

Scaling game assets 450 is generally done to accommodate the capabilities of the device. While a typical wagering game machine can utilize all of the game assets 450 fully, a mobile phone may need a stripped down version. A PC tablet may require a middle weight version. Systems and methods can automatically scale assets 450 to the appropriate level required by the various devices to maximize performance. In other words, features may be automatically enabled and disabled based on the capabilities of the available platform.

Scaling features (capabilities) as described herein can be implemented in hardware, software, or any combination thereof. For example, various display modifications between platforms can be implemented with a combination of hardware (e.g., video cards and video processors) and software (e.g., video drivers, operating software, and game software). Additionally, accumulation and transferring of assets can be provided through the use of hardware, software, or any combination thereof.

Each of the embodiments described herein are contemplated as falling within the inventive subject matter, which is set forth in the following claims.

The invention claimed is:

1. A computer-implemented method of conducting a wagering game on multiple game platforms, the method comprising:

operating the wagering game with a player on a first game platform, the operating including ending the wagering game at a game state, the first game platform comprising first components, the first components including a first display device, a first input device, a first processor, and a first memory device;

detecting the player at a second game platform and automatically authenticating the player at a second game platform;

while the wagering game operated on the first game platform is still in play, continuing to operate the still-in-play wagering game on the second game platform, the continuing to operate including restoring the wagering game to the game state, the second game platform comprising second components, the second components including a second display device, a second input device, a second processor, and a second memory device; and wherein a difference between at least one of the first components and at least one of the second components causes the wagering game to be implemented differently on the second game platform than on the first game platform, and wherein the wagering game is operated with the same player on the first and second game platforms.

2. The method of claim 1, wherein the wagering game includes at least one player asset that is accumulated while operating the wagering game on the first game platform and that persists from the first game platform to the second game platform.

3. The method of claim 2, wherein the at least one player asset is associated with the player.

4. The method of claim 3, wherein the at least one player asset includes one or more of an experience level, a rank, a title, a character, and a character trait.

5. The method of claim 1, wherein implementing the wagering game differently includes using a different data processing capability on the second game platform than on the first game platform.

6. The method of claim 1, wherein implementing the wagering game differently includes displaying a visual element from the first game platform as a non-identical representation of the visual element on the second game platform.

7. The method of claim 1, wherein implementing the wagering game differently includes displaying a visual element from the first game platform at a different display resolution on the second game platform.

8. The method of claim 1, wherein implementing the wagering game differently includes reducing a pictorial element from the first game platform to a simplified representation of the pictorial element on the second game platform, or enhancing a simple pictorial element from the first game platform to a complex representation of the simple pictorial element on the second game platform.

9. The method of claim 8, wherein the simplified representation of the pictorial element comprises an alphanumeric representation.

10. The method of claim 1, wherein implementing the wagering game differently includes using a first technique of rendering a visual element on the first game platform and a second technique on the second game platform.

11. The method of claim 1, wherein implementing the wagering game differently includes using a first source of video content on the first game platform and a second source on the second game platform.

12. The method of claim 1, wherein implementing the wagering game differently includes using animated visual elements on the first game platform and using static visual elements in place of the animated visual elements on the second game platform, or using static visual elements on the first game platform and animated visual elements in place of the static visual elements on the second game platform.

13. The method of claim 1, wherein implementing the wagering game differently includes using a visual element on the first game platform and using an audio element in place of the visual element on the second game platform, or using an audio element on the first game platform and a visual element in place of the audio element on the second game platform.

14. The method of claim 1, wherein implementing the wagering game differently includes using a mechanical device on the first game platform and using a video display in place of the mechanical device on the second game platform, or using a video display on the first game platform and using a mechanical device in place of the video display on the second game platform.

15. The method of claim 1, wherein implementing the wagering game differently includes using 3-dimensional elements on the first game platform and 2-dimensional elements in place of the 3-dimensional elements on the second game platform, or using 2-dimensional elements on the first game platform and 3-dimensional elements in place of the 2-dimensional elements on the second game platform.

16. The method of claim 1, wherein implementing the wagering game differently includes using a first technique of filtering 3-dimensional elements on the first game platform and a second technique on the second game platform.

17. The method of claim 1, wherein implementing the wagering game differently includes using a first set of sprites as visual elements on the first game platform and a second set of sprites on the second game platform.

18. A gaming system operable to conduct a wagering game, the gaming system comprising:

a first game platform for operating the wagering game including ending the wagering game at a game state, the first game platform comprising first components including a first display device, a first input device, a first processor, and a first memory device; and a second game platform for continuing to operate the wagering game that was operated on the first game platform while the wagering game is still in play, the continuing to operate including restoring the wagering game to the game state, the second game platform comprising second components including a second display device, a second input device, a second processor, and a second memory device;

wherein a difference between at least one of the first components and at least one of the second components causes the wagering game to be implemented differently on the second game platform than on the first game platform, the wagering game being operated with the same player on the first and second game platforms, and the player being automatically authenticated at the second game platform.

19. The gaming system of claim 18, wherein the wagering game includes at least one player asset that is accumulated while operating the wagering game on the first game platform and that persists from the first game platform to the second game platform.

20. The gaming system of claim 19, wherein the at least one player asset is associated with the player.

21. The gaming system of claim 20, wherein the at least one player asset includes one or more of an experience level, a rank, a title, a character, and a character trait.

22. The gaming system of claim 18, wherein the first game platform and the second game platform are connected for communication via a wagering game network.

23. The gaming system of claim 18, wherein the wagering game transitions from the first game platform to the second game platform with no perceptible drop in connection between the first and second game platforms.

24. The gaming system of claim 18, wherein implementing the wagering game differently includes using a different data processing capability on the second game platform than on the first game platform.

25. The gaming system of claim 18, wherein implementing the wagering game differently includes displaying a visual element from the first game platform as a non-identical representation of the visual element on the second game platform.

26. The gaming system of claim 18, wherein implementing the wagering game differently includes displaying a visual element from the first game platform at a different display resolution on the second game platform.

27. A computer-readable, non-transitory medium storing instructions that cause a gaming system to perform the method of:

operating the wagering game with a player on a first game platform, the first game platform comprising first components, the first components including a first display device, a first input device, a first processor, and a first memory device, the operating including ending the wagering game at a game state;

detecting the player at a second game platform and automatically authenticating the player at the second game platform;

while the wagering game operated on the first game platform is still in play, continuing to operate the still-in-play wagering game on a second game platform comprising second components, the second components including a second display device, a second input device, a second processor, and a second memory device, the continuing to operate including restoring the wagering game to the game state, the second game platform;

wherein a difference between at least one of the first components and at least one of the second components causes the wagering game to be implemented differently on the second game platform than on the first game platform, and wherein the wagering game is operated with the same player on the first and second game platforms.

28. The computer-readable medium of claim 27, wherein the first game platform and the second game platform are connected for communication via a wagering game network.

29. The computer-readable medium of claim 28, wherein the medium resides on a wagering game server and communicates with the first and second game platforms via the wagering game network.

* * * * *